US008307686B1

(12) United States Patent
Chuang

(10) Patent No.: US 8,307,686 B1
(45) Date of Patent: Nov. 13, 2012

(54) STRUCTURE OF ROLL-FORMING MACHINE

(76) Inventor: Sen-Jung Chuang, Taipei County (TW)

( * ) Notice: Subject to any disclaimer, the term of this patent is extended or adjusted under 35 U.S.C. 154(b) by 490 days.

(21) Appl. No.: 12/651,997

(22) Filed: Jan. 4, 2010

(51) Int. Cl.
*B21D 5/08* (2006.01)

(52) U.S. Cl. ..... 72/181

(58) Field of Classification Search ..... 72/176, 72/178, 179, 180, 181, 182; 100/161, 168, 100/173

See application file for complete search history.

(56) References Cited

U.S. PATENT DOCUMENTS

| | | | | |
|---|---|---|---|---|
| 5,163,311 | A * | 11/1992 | McClain et al. | 72/181 |
| 5,829,295 | A * | 11/1998 | Voth et al. | 72/181 |
| 6,216,514 | B1 * | 4/2001 | Bradbury et al. | 72/178 |
| 6,289,708 | B1 * | 9/2001 | Keinanen | 72/178 |
| 7,231,796 | B1 * | 6/2007 | Chuang | 72/181 |
| 8,186,197 | B2 * | 5/2012 | Walle | 72/181 |

* cited by examiner

*Primary Examiner* — Edward Tolan

(74) *Attorney, Agent, or Firm* — Jackson IPG PLLC

(57) ABSTRACT

A roll-forming machine formed of a machine base, a guide block unit, pairs of forming roll sets, a first adjustable shape-forming wheel set, a second adjustable shape-forming wheel set, a first lower auxiliary shape-forming wheel set, a second lower auxiliary shape-forming wheel set, an upper auxiliary shape-forming wheel set, a small straightener and a big straightener for the formation of a C-shaped component or a Z-shaped component from a sheet material is disclosed in such a manner that a wide space is provided around each of the adjustable shape-forming wheel assembly, the non-adjustable shape-forming wheel assembly and the adjustable shape-forming wheel set to facilitate maintenance work and, the coupling walls and sidewalls of the non-adjustable shape-forming wheel assembly and the adjustable shape-forming wheel set are mounted with respective pivot shafts and fastening members for quick positioning of the respective shape-forming wheels, assuring high stability and accurate processing.

3 Claims, 24 Drawing Sheets

STRUCTURE OF ROLL-FORMING MACHINE

BACKGROUND AND SUMMARY OF THE INVENTION

The present invention relates to a roll-forming machine adjustable to fit different thickness of sheet materials for the formation of a C-shaped component or a Z-shaped selectively and more particularly, to an improved structure of roll-forming machine, which facilitates maintenance and repair works and assures high stability and processing accuracy.

Many roll-forming machines are known and used to transform a planar sheet of metal into a component having either a C-shaped or Z-shaped cross-sectional area. U.S. Pat. No. 6,216,514 B1 is a typical one of these designs. This design, as shown in FIG. 1, is still not satisfactory in function because of the following drawbacks:

1. Forming rolls 91, 92, transferring rolls 931, 941, gears 961 and axle sleeve means 973 are respectively provided at the upper-sided shaft members 981; transferring rolls 932, 942, gears 962 and axle sleeve means 974 are respectively provided at the lower-sided shaft members 982. When the transferring rolls 931, 932, 941, 942 start to wear or other related component parts are damaged, locating members 951, 952, gears 961, 962, axle sleeve means 971, 972, 973, 974 and shaft members 981, 982 must be detached, so that the repair or replacement work can be started. After the repair or replacement work, the detached component parts must be installed again, i.e., much labor and time are wasted during a repair or replacement work.
2. For making different C-shaped or Z-shaped components, different transferring rolls 931, 932, 941, 942 and forming rolls 91, 92 shall be used. At this time, the machine must be shut down for replacement of different transferring rolls 931, 932, 941, 942 and forming rolls 91, 92, wasting much labor and time.

U.S. Pat. No. 7,243,519, issued to the present inventor, as shown in FIGS. 2 and 3, discloses a roll-forming machine, which comprises a machine base 900, and pairs of forming roll sets 90 bilaterally arranged on the top side of the machine base 900 for the formation of a C-shaped component or a Z-shaped component from a sheet material. The wheel shafts of the shape-forming wheels 904 of the $1^{st}$ and $4^{th}$ pairs of the forming roll sets 90 are respectively mounted with a respective locating block through which the respective wheel shafts can be rotated through 180-degrees between two positions and locked by a respective locating rod, setting the roll-forming machine for processing C-shaped component or Z-shaped component. However, the shape-forming wheels 904 wear quickly with use. When repairing or replacing one damaged shape-forming wheel 904, the worker must detach the transmission component parts of the corresponding upper impression wheel 902, and then remove the respective top block 9011 from the respective rack 901, and then unfasten the fastening members of the respective locating block 905 and remove the corresponding pin 906 for allowing removal of the damaged shape-forming wheel 904. Because each shape-forming wheel 904 is provided between the upper wheel holder 9012 and lower wheel holder 9013 at the rack 901, there is little space around each shape-forming wheel 904. In consequence, the procedure of repairing or calibrating each shape-forming wheel is complicated.

The present invention has been accomplished under the circumstances in view. It is therefore the main object of the present invention to provide a roll-forming machine, which eliminates the aforesaid drawbacks.

According to one aspect of the present invention, the roll-forming machine is comprised of a machine base, a guide block unit, pairs of forming roll sets, a first adjustable shape-forming wheel set, a second adjustable shape-forming wheel set, a first lower auxiliary shape-forming wheel set, a second lower auxiliary shape-forming wheel set, an upper auxiliary shape-forming wheel set, a small straightener and a big straightener for the formation of a C-shaped component or a Z-shaped component from a sheet material The adjustable shape-forming wheel assembly and non-adjustable shape-forming wheel assembly of the first adjustable shape-forming wheel set and the adjustable shape-forming wheel set are respectively connected to the corresponding racks of the sheet-transfer roll sets through respective connection frame bars. Therefore, a wide space is provided around each of the adjustable shape-forming wheel assembly, the non-adjustable shape-forming wheel assembly and the adjustable shape-forming wheel set, facilitating mounting and dismounting.

According to another aspect of the present invention, when the upper shape-forming wheel or lower shape-forming wheel of the adjustable shape-forming wheel assembly or the upper shape-forming wheel or lower shape-forming wheel of the non-adjustable shape-forming wheel assembly or the upper shape-forming wheel or lower shape-forming wheel of the adjustable shape-forming wheel set is damaged and a repair work is necessary, the associating fastening members and pivot shaft can be removed conveniently for quick performance of the repair work.

According to still another aspect of the present invention, the coupling walls and sidewalls of the non-adjustable shape-forming wheel assembly and the adjustable shape-forming wheel set are mounted with respective pivot shafts and fastening members for quick positioning of the respective shape-forming wheels, assuring high stability and accurate processing.

DETAILED DESCRIPTION OF THE INVENTION

Figure 1:
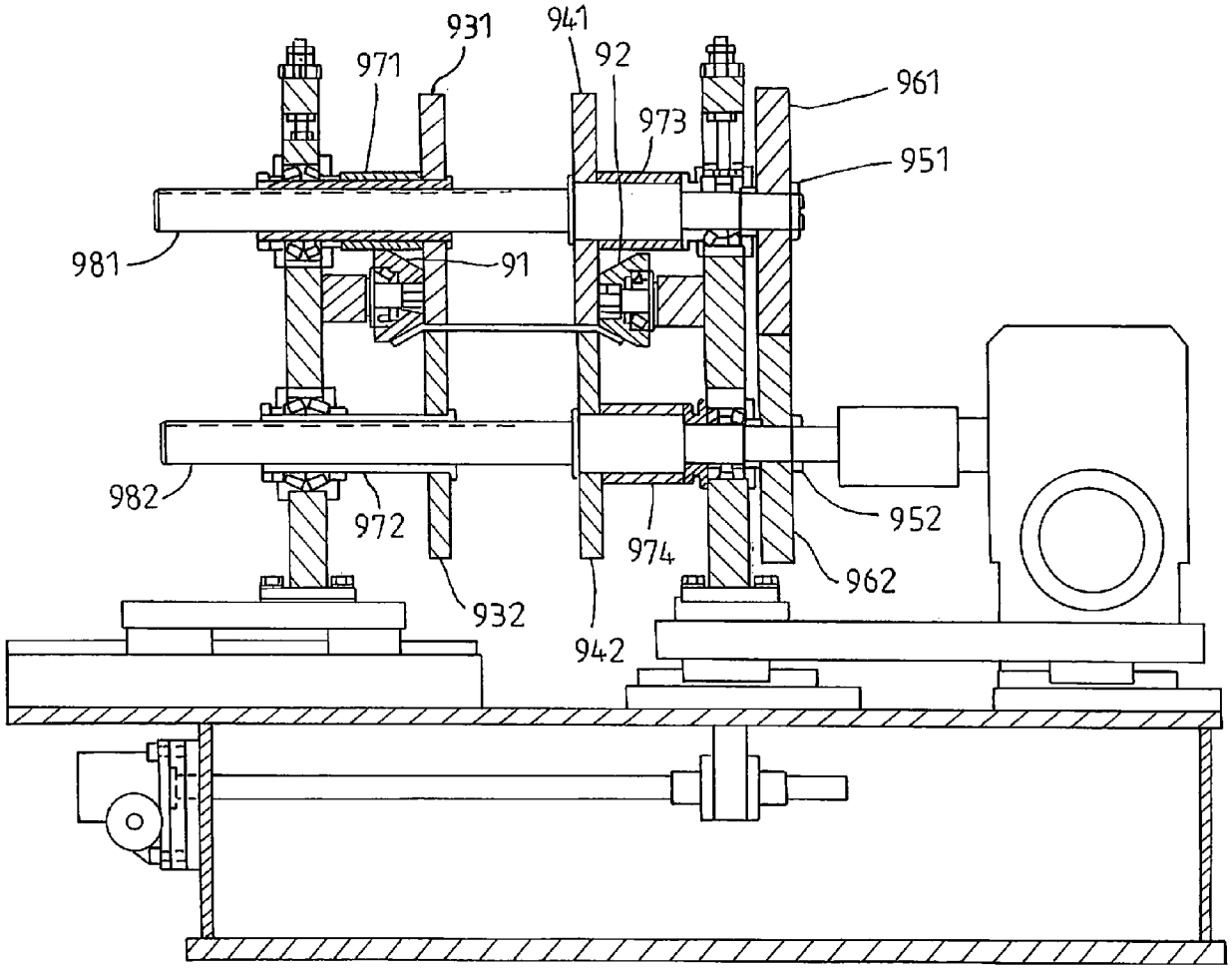
Fig. 1 PRIOR ART
FIG. 1 is a plain view of a roll-forming machine according to the prior art.
Figure 2:
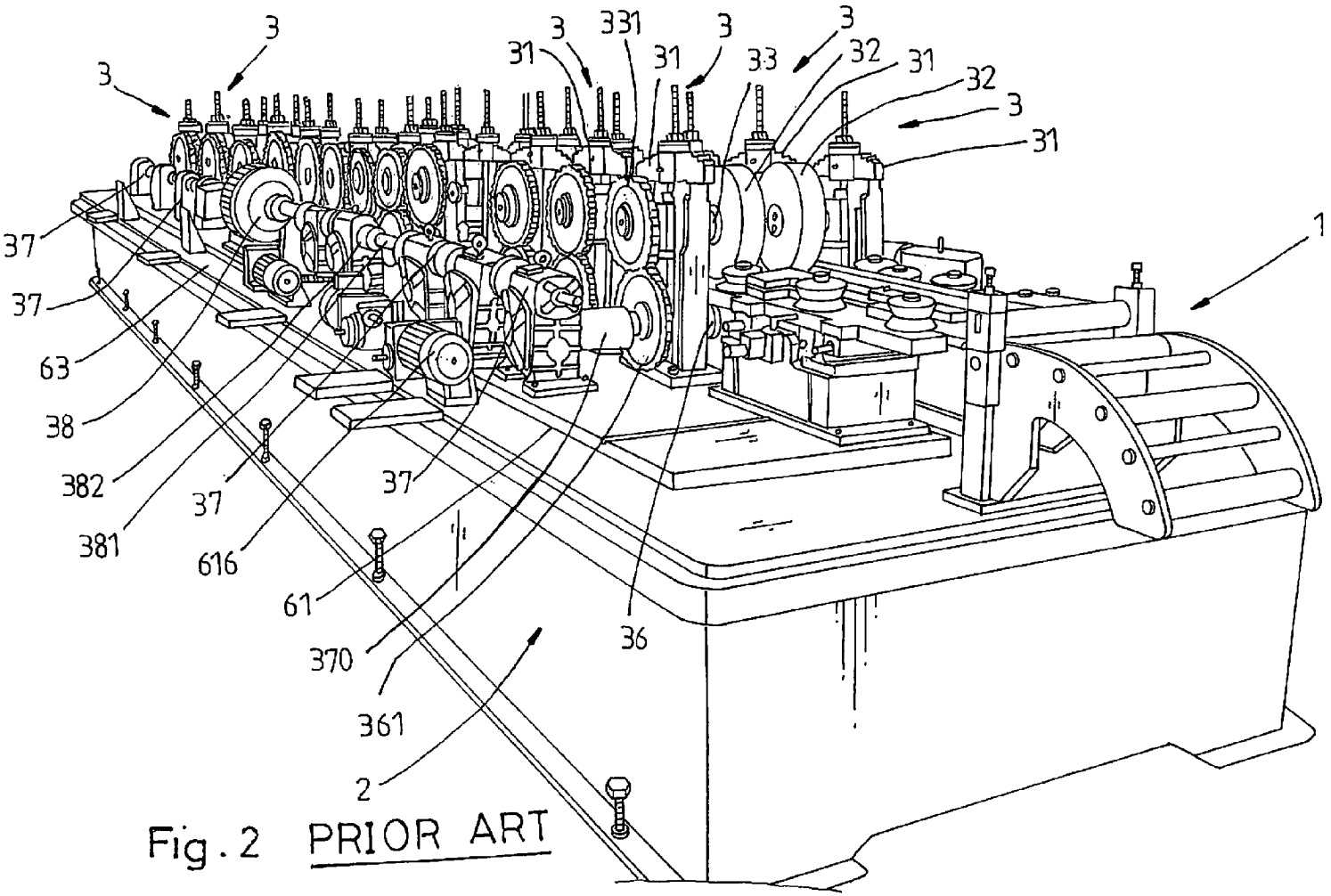
Fig. 2 PRIOR ART
FIG. 2 is an oblique elevation of another structure of roll-forming machine according to the prior art.
Figure 3:
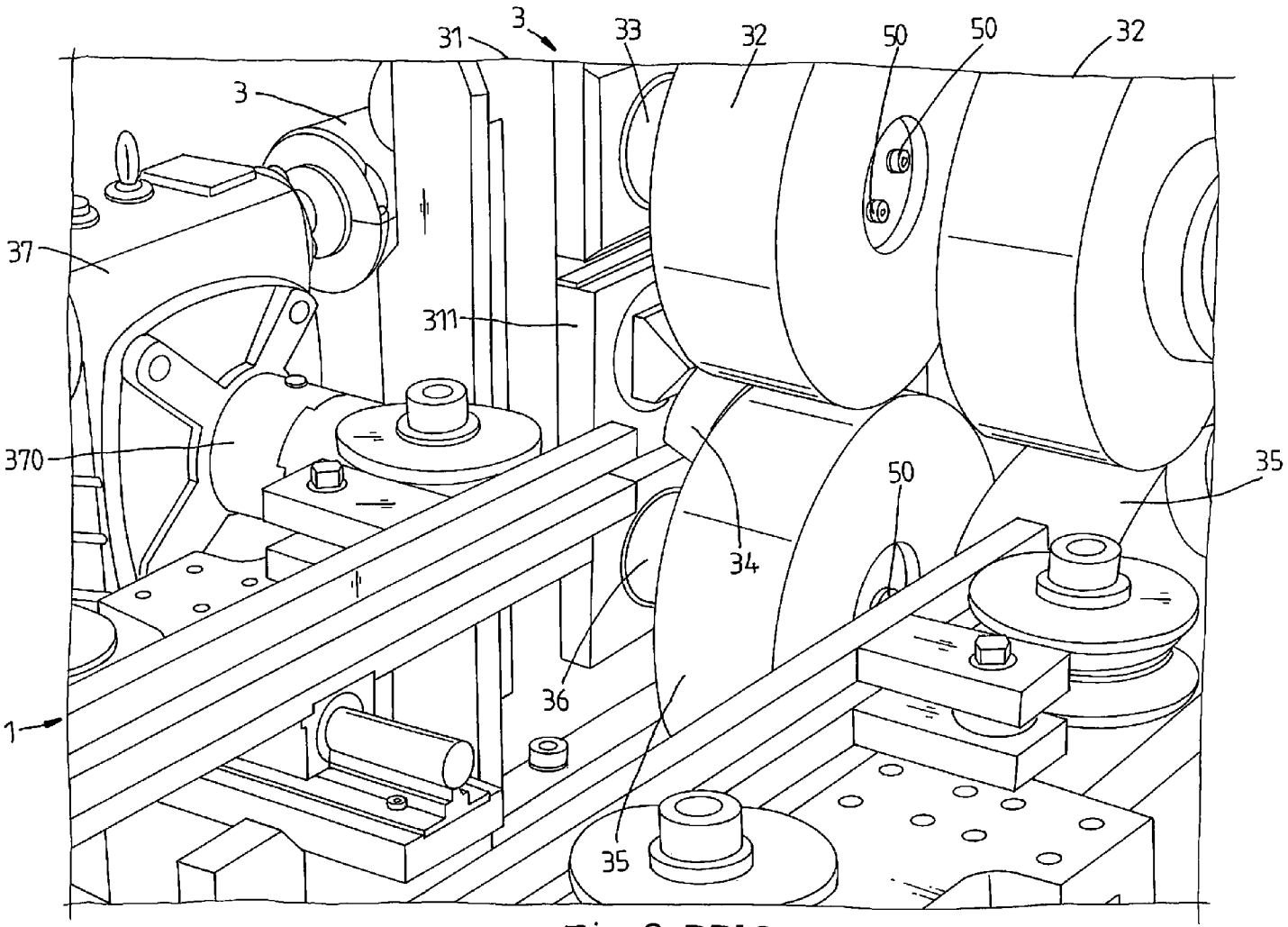
Fig. 3 PRIOR ART
FIG. 3 is an enlarged view of a part of FIG. 2.
Figure 4:
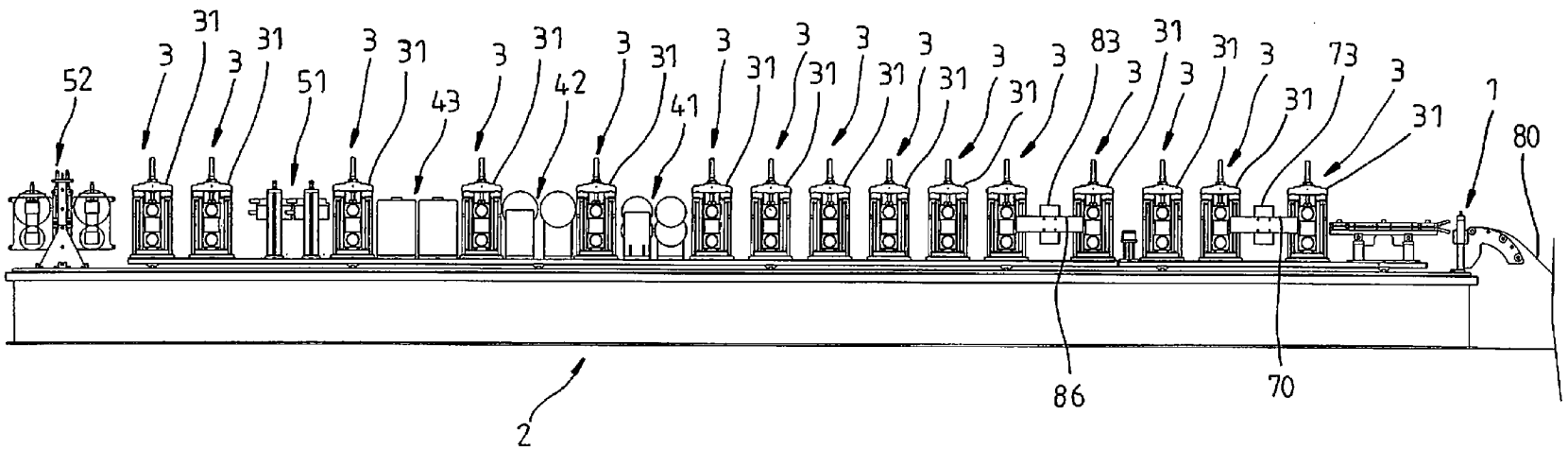
FIG. 4 is a side plain view of a roll-forming machine according to the present invention.
Figure 5:
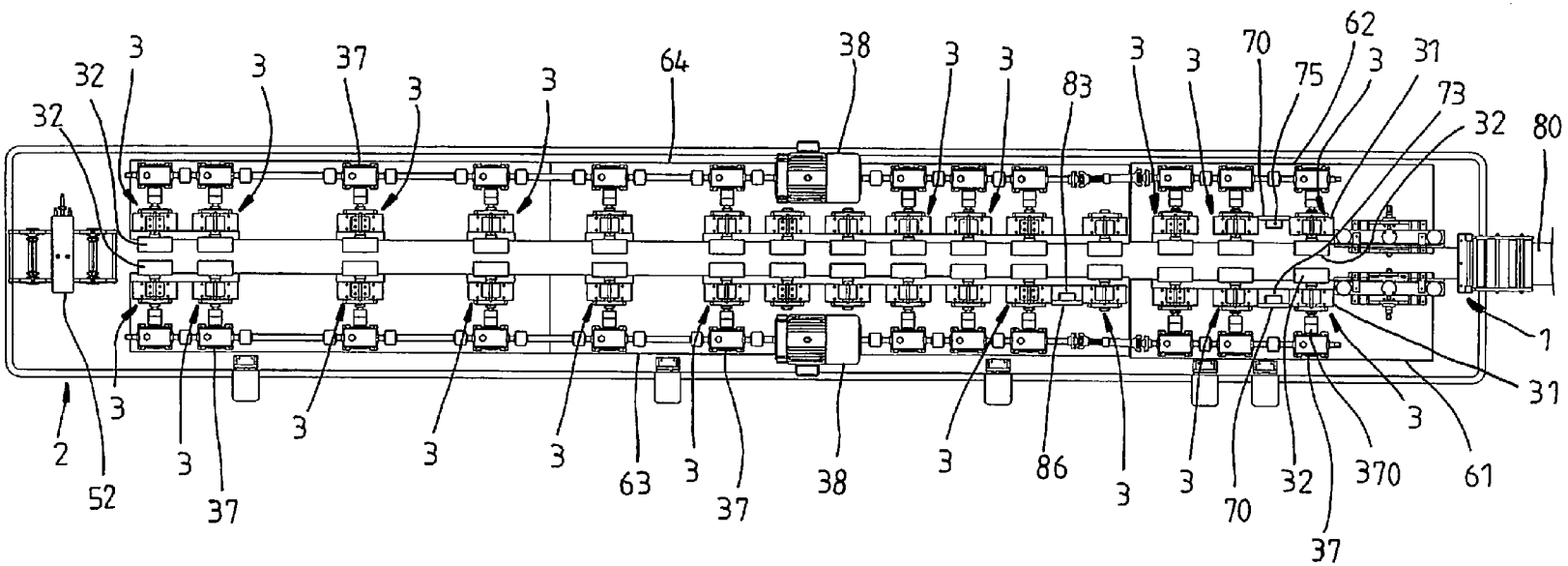
FIG. 5 is a top view of the roll-forming machine according to the present invention.

Referring to FIGS. 3~30, a roll-forming machine in accordance with the present invention is shown adapted to facilitate the formation of either a C-shaped component or a Z-shaped component selectively from a sheet of material. The roll-forming machine comprises a machine base 2, a guide block unit 1 provided at the front top side of the machine base 2 thereof for guiding a sheet material 80 to the machine base 2 for processing, pairs of forming roll sets 3, a first adjustable shape-forming wheel set 7, a second adjustable shape-forming wheel set 8, a first lower auxiliary shape-forming wheel set 41, a second lower auxiliary shape-forming wheel set 42, an upper auxiliary shape-forming wheel set 43, a small straightener 51, and a big straightener 52.

Figure 11:
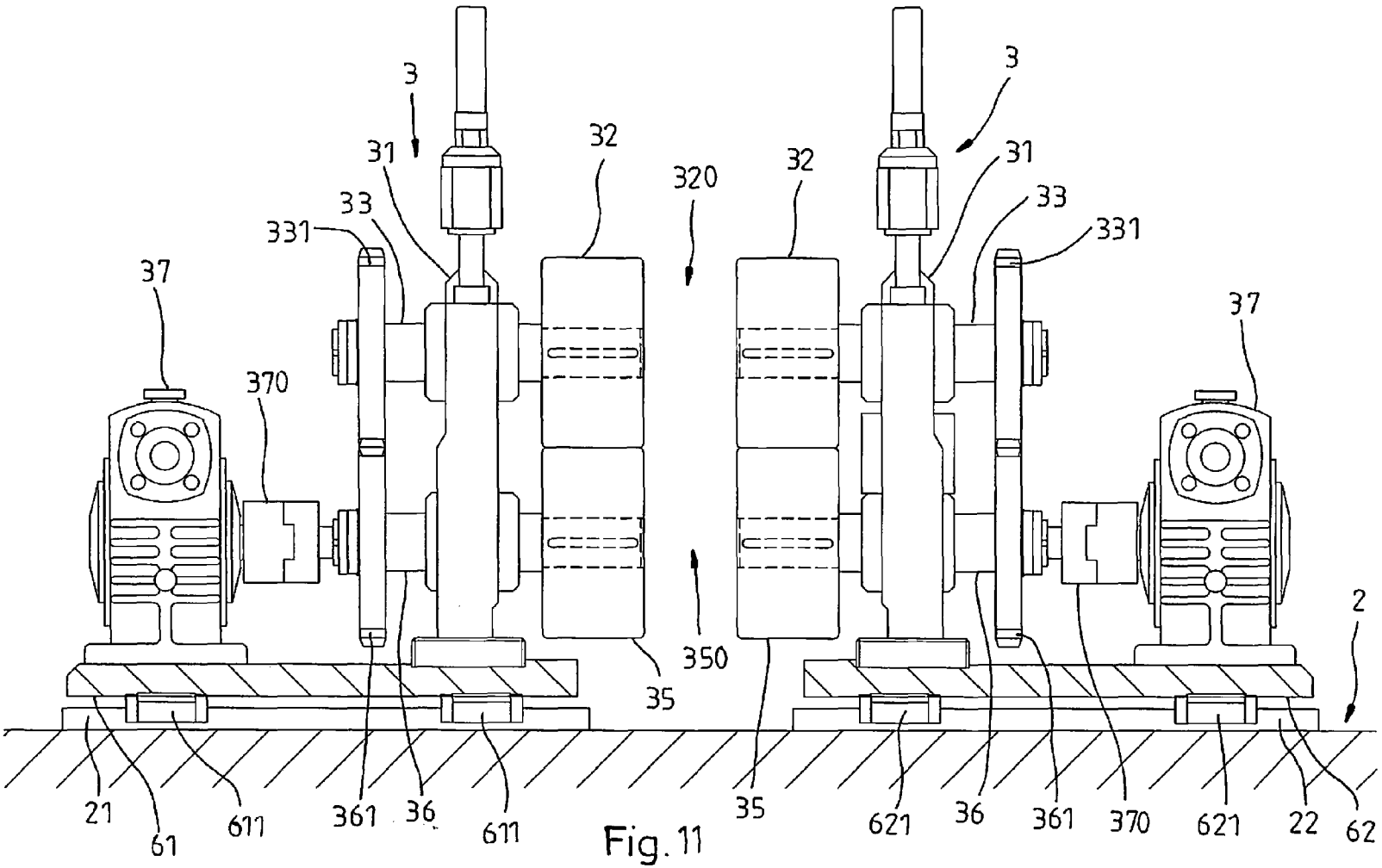
FIG. 11 is a schematic plain view in an enlarged scale of a part of the roll-forming machine according to the present invention.
Figure 12:
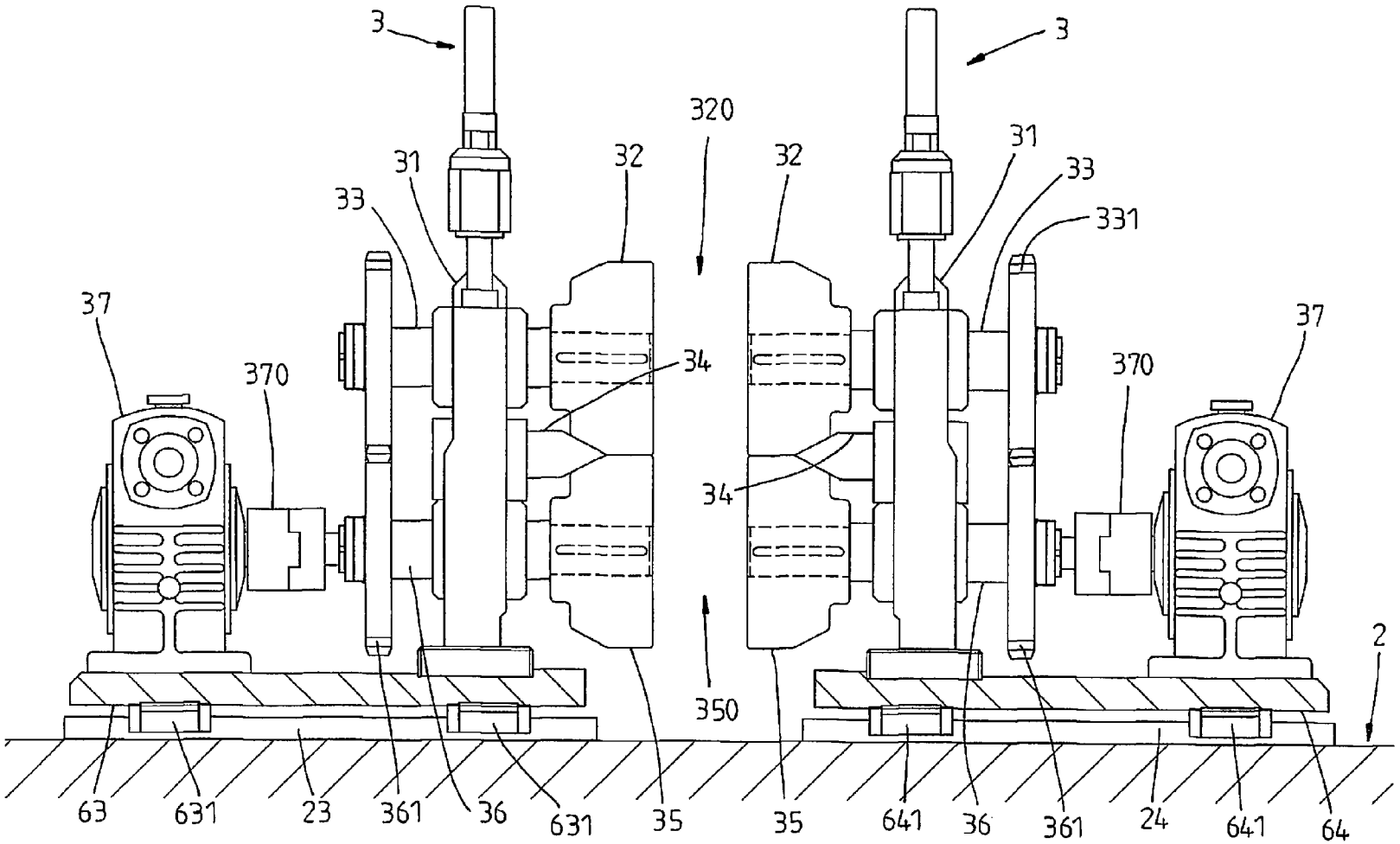
FIG. 12 is a schematic plain view in an enlarged scale of another part of the roll-forming machine according to the present invention.
Figure 13:
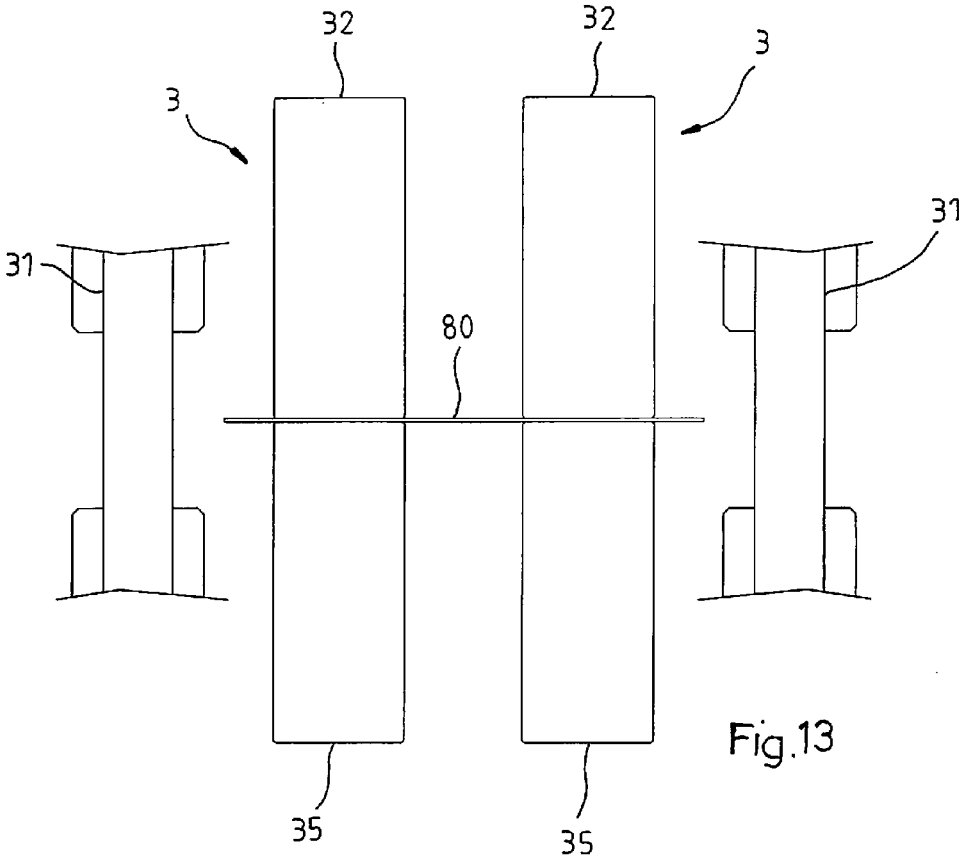
FIG. 13 is a schematic plain view showing the sheet material processed through a first air of forming roll set rammed according to the present invention.
Figure 14:
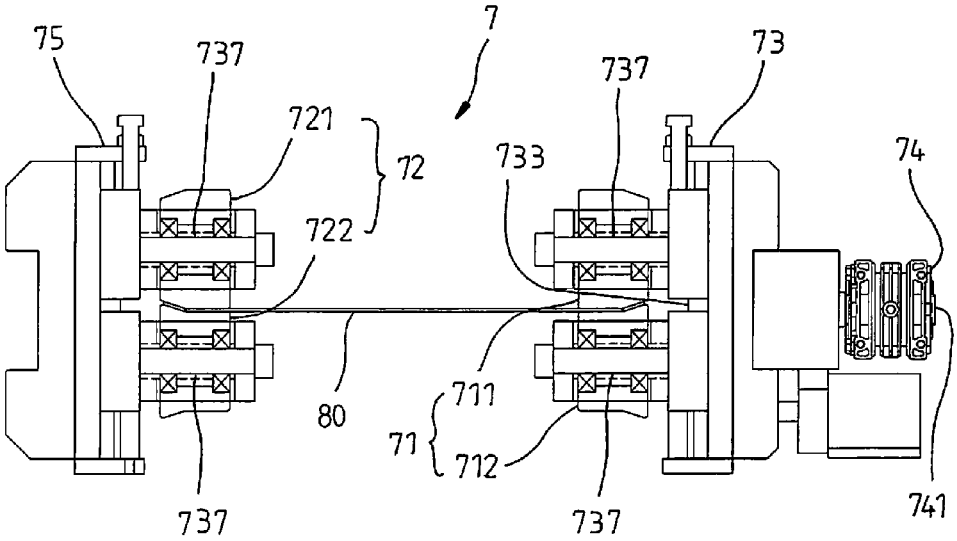
FIG. 14 is a schematic plain view showing the sheet material rammed by the adjustable shape-forming wheel set according to the present invention.
Figure 15:
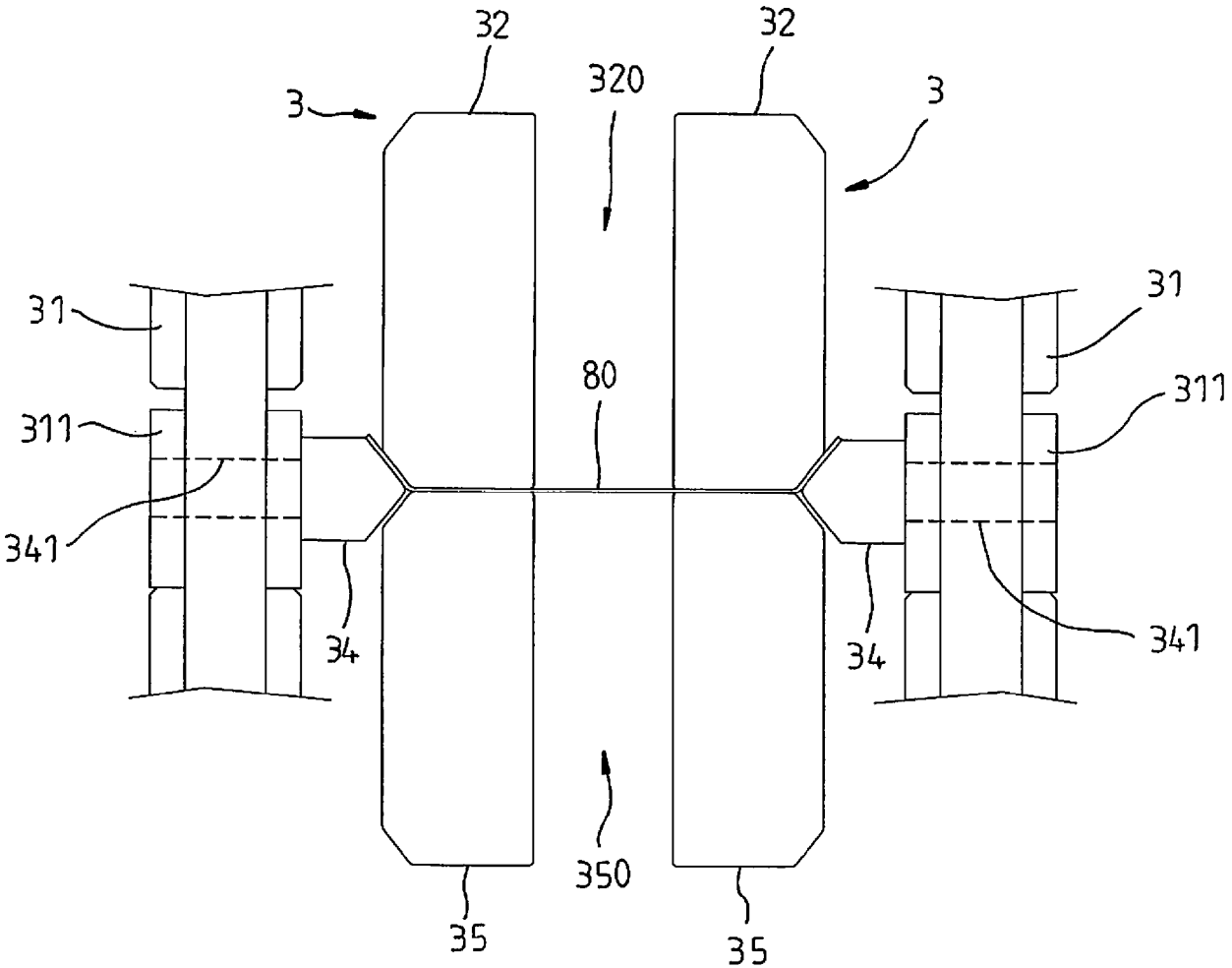
FIG. 15 is a schematic plain view showing the sheet material rammed by another forming roll set according to the present invention.
Figure 16:
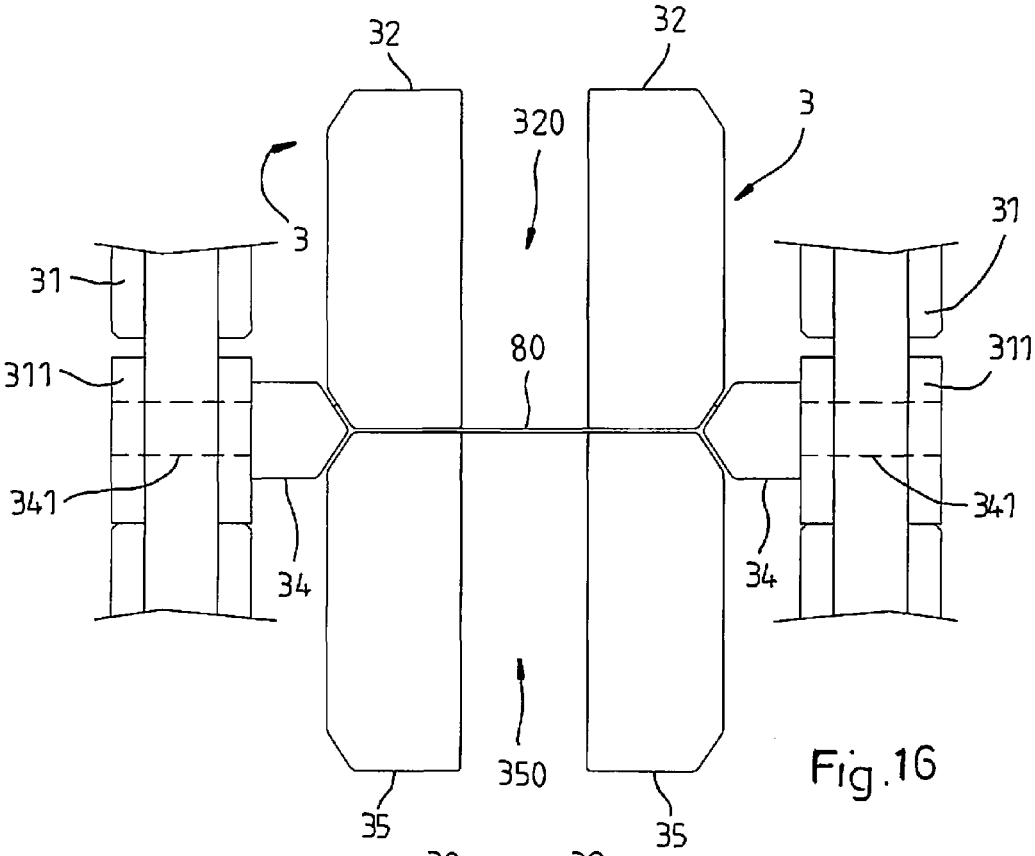
FIG. 16 is a schematic plain view showing the sheet material rammed by still another forming roll set according to the present invention.
Figure 17:
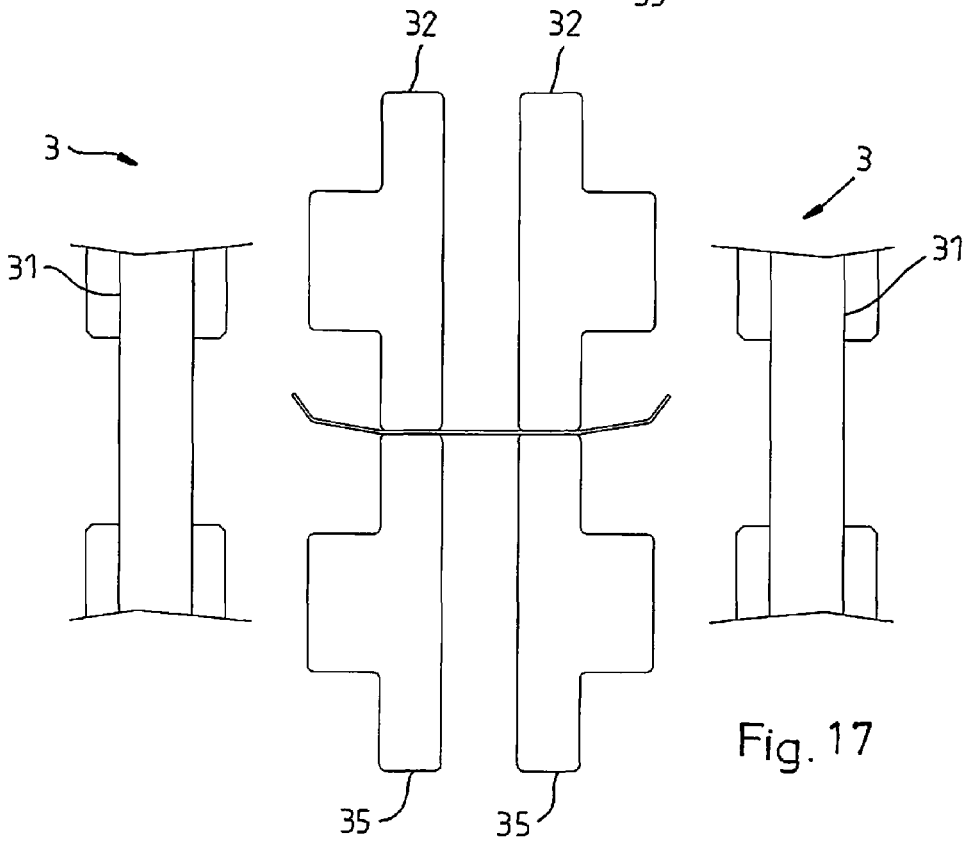
FIG. 17 is a schematic plain view showing the sheet material rammed by the fourth pair of forming roll sets according to the present invention.
Figure 18:
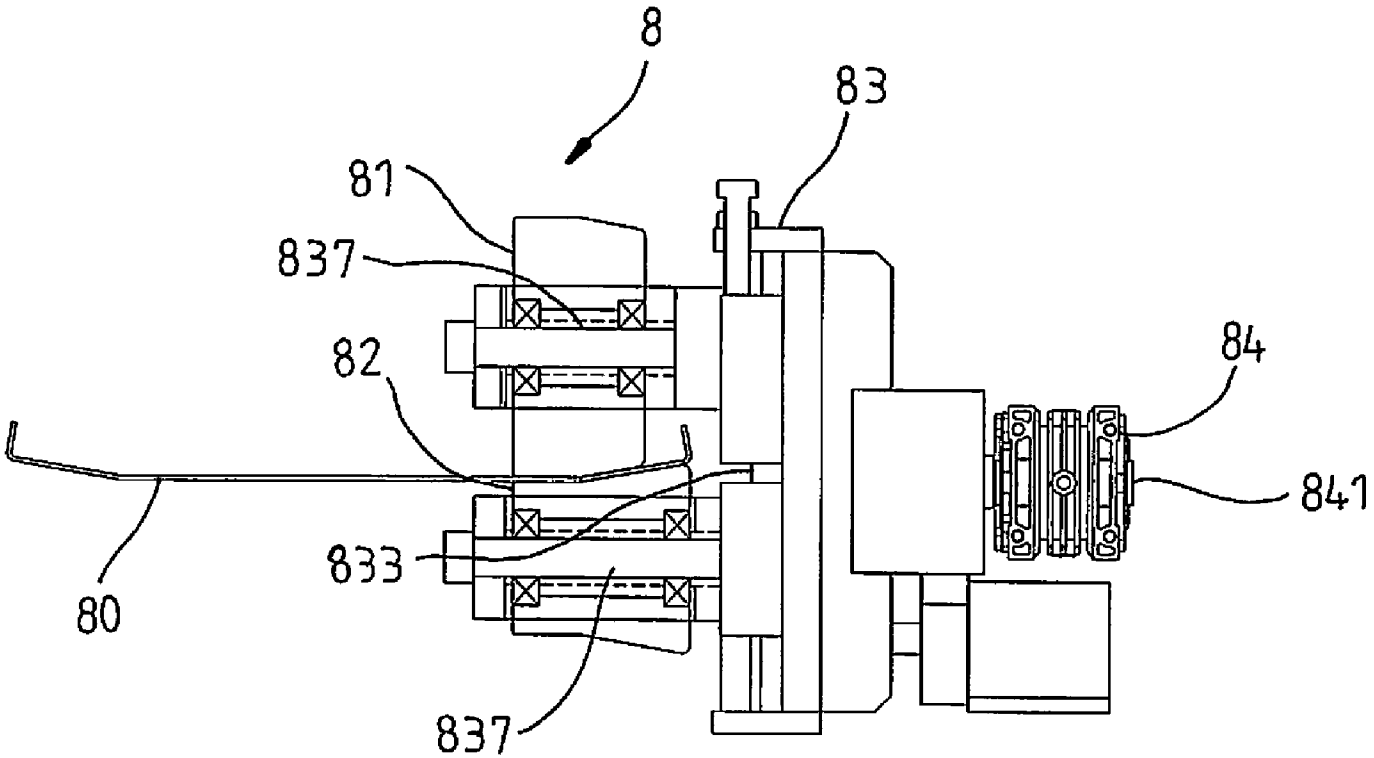
FIG. 18 is a schematic plain view showing the sheet material rammed by the second adjustable shape-forming wheel set according to the present invention.
Figure 19:
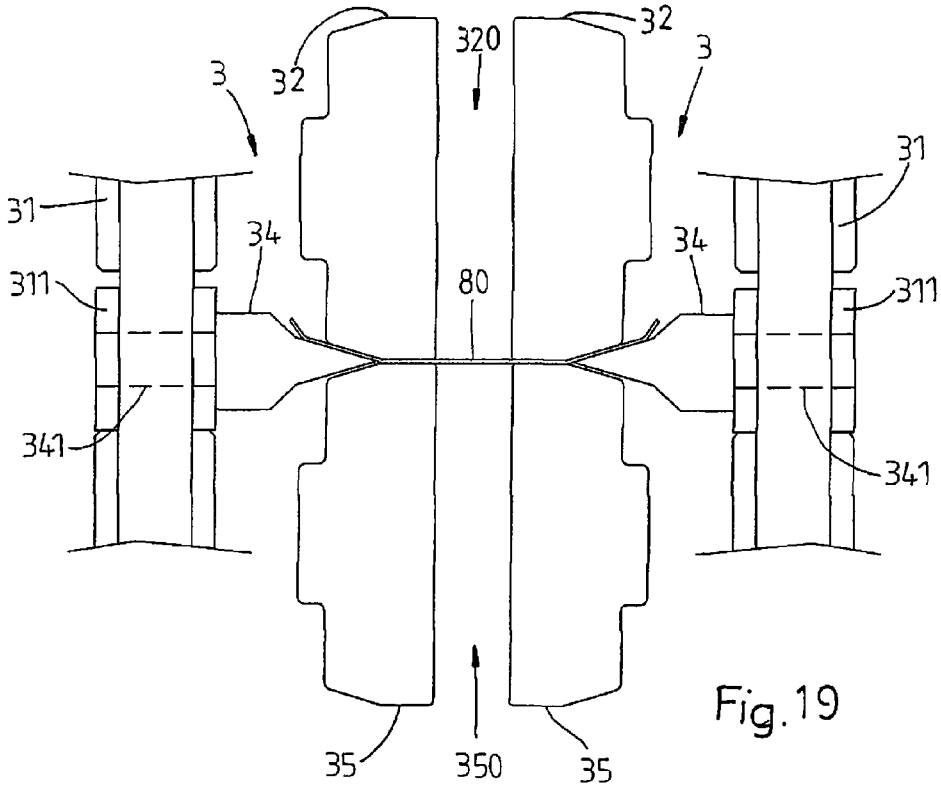
FIG. 19 is a schematic plain view showing the sheet material rammed by still another pair of forming roll sets according to the present invention.
Figure 20:
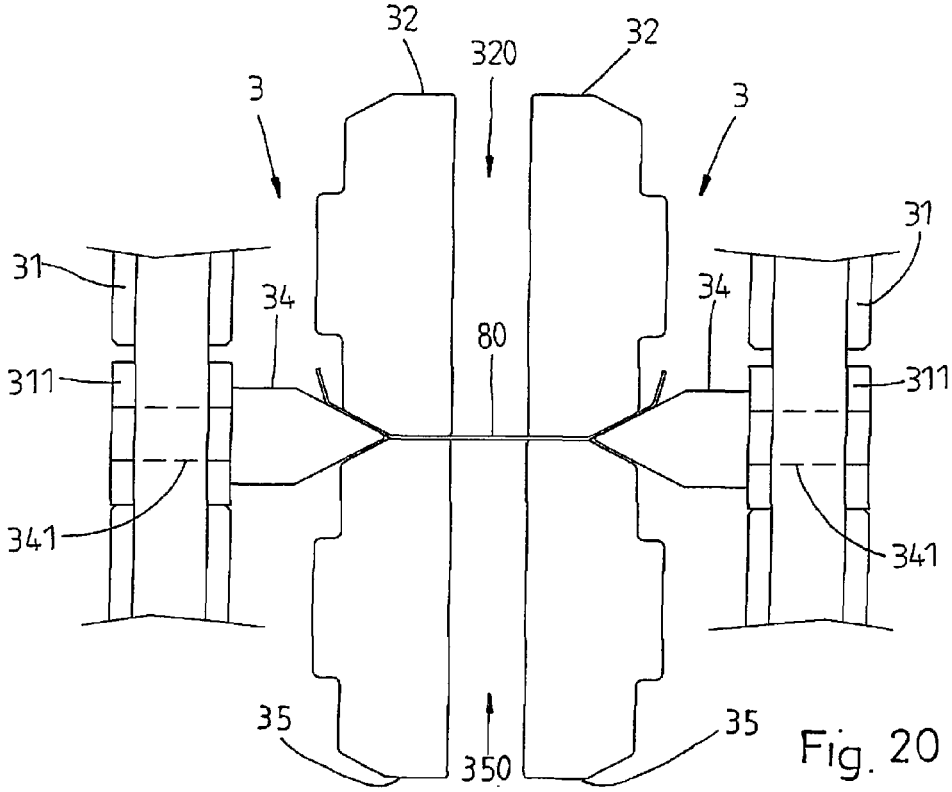
FIG. 20 is a schematic plain view showing the sheet material rammed by still another pair of forming roll sets according to the present invention.
Figure 21:
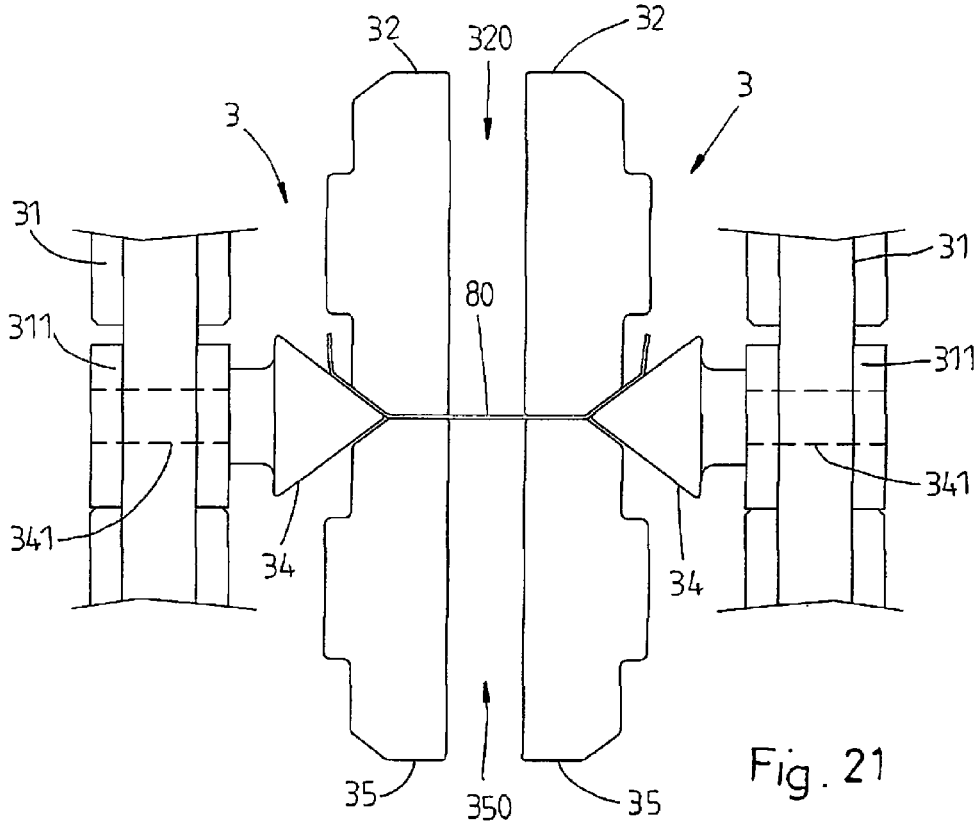
FIG. 21 is a schematic plain view showing the sheet material rammed by still another pair of forming roll sets according to the present invention.
Figure 22:
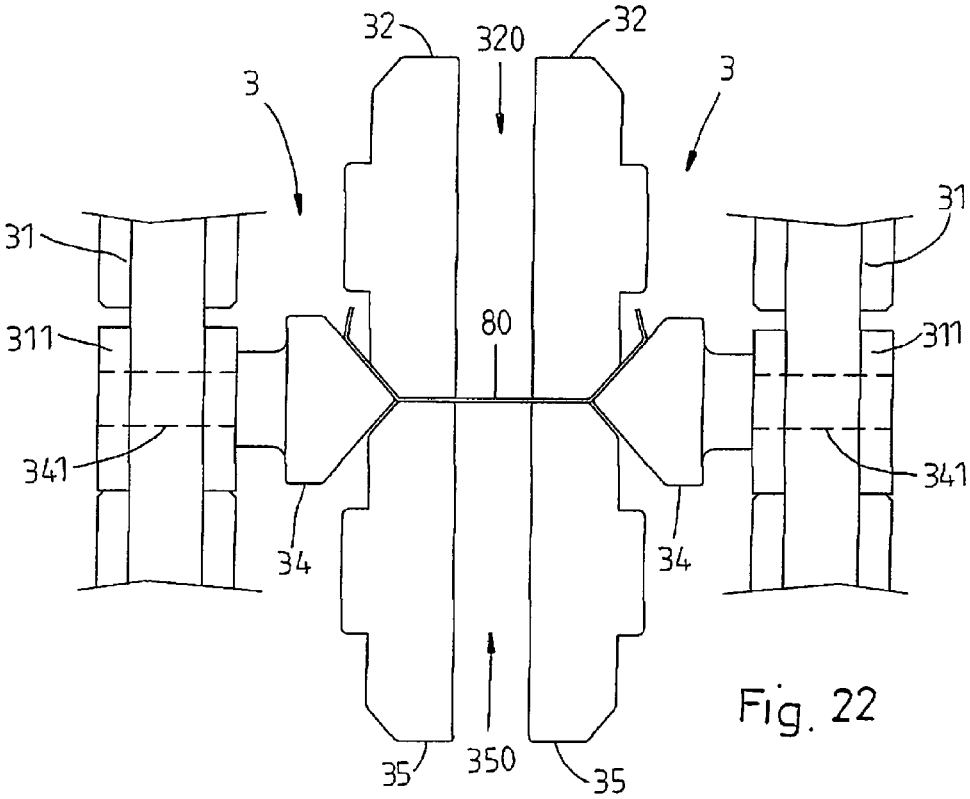
FIG. 22 is a schematic plain view showing the sheet material rammed by still another pair of forming roll sets according to the present invention.
Figure 23:
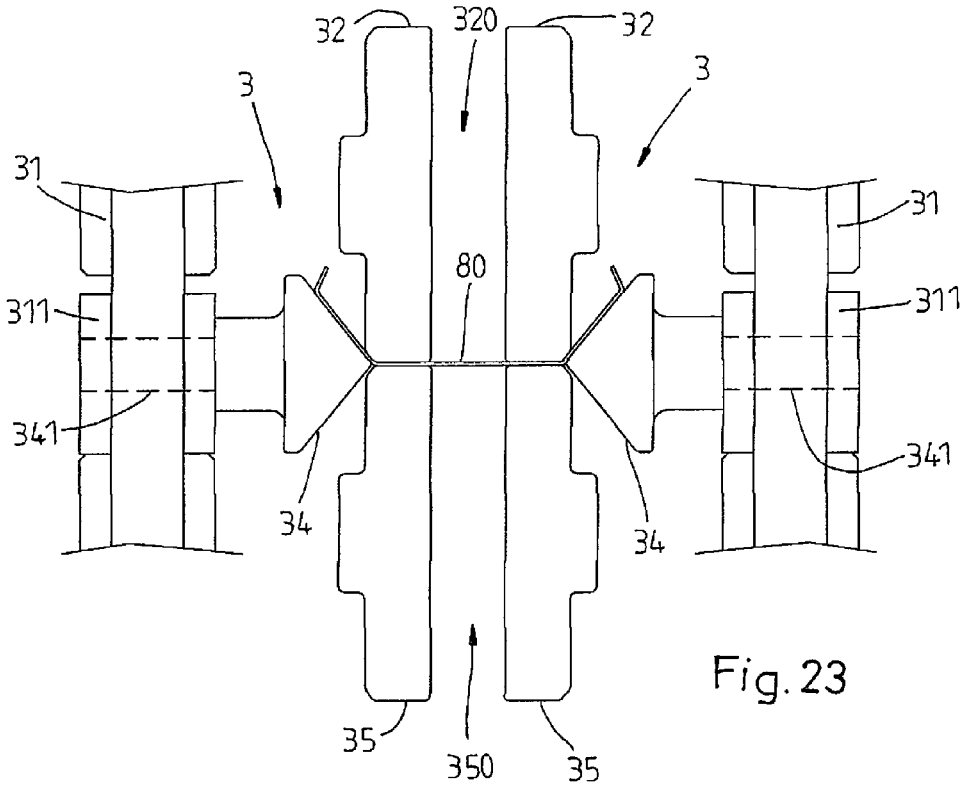
FIG. 23 is a schematic plain view showing the sheet material rammed by still another pair of forming roll sets according to the present invention.
Figure 24:
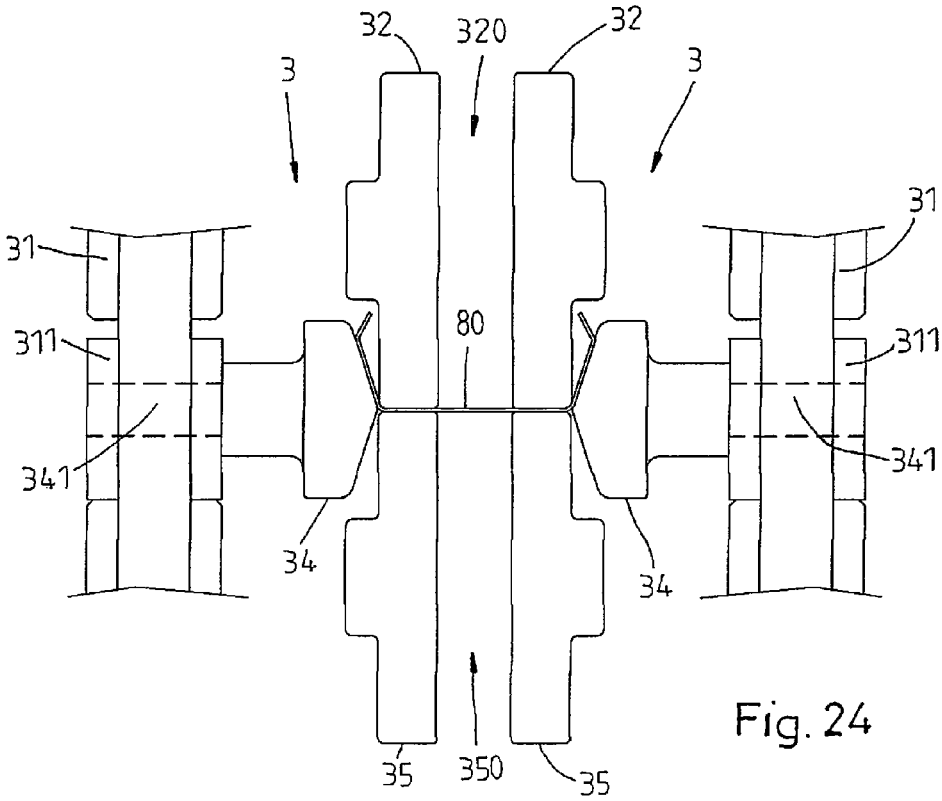
FIG. 24 is a schematic plain view showing the sheet material rammed by still another pair of forming roll sets according to the present invention.
Figure 25:
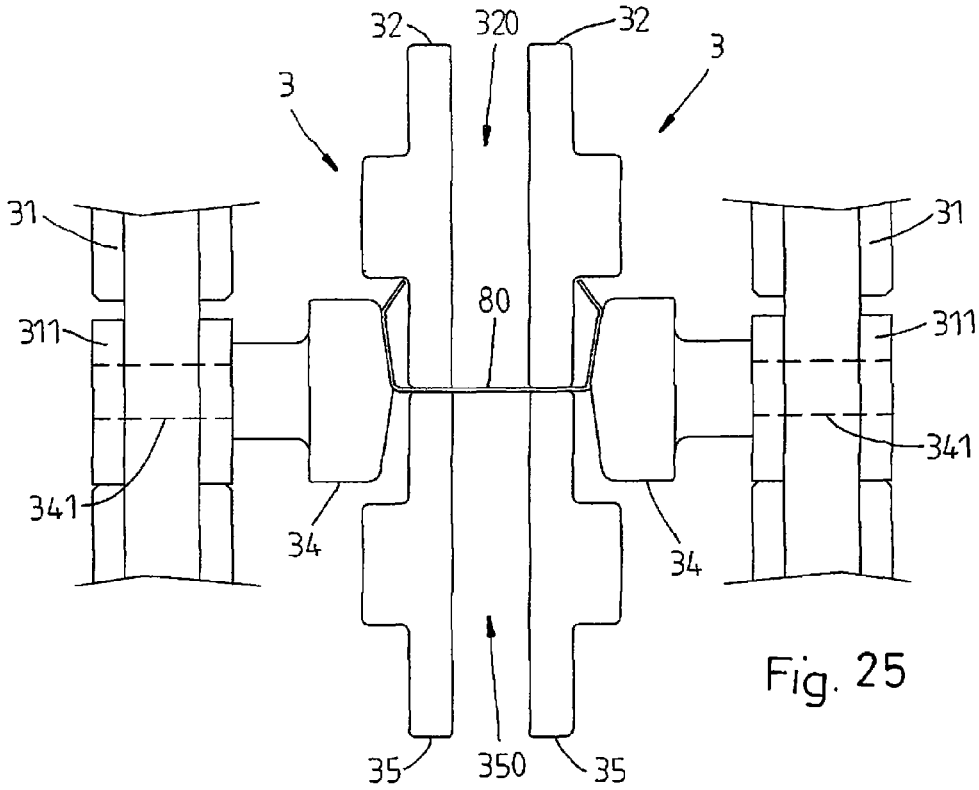
FIG. 25 is a schematic plain view showing the sheet material rammed by still another pair of forming roll sets according to the present invention.
Figure 26:
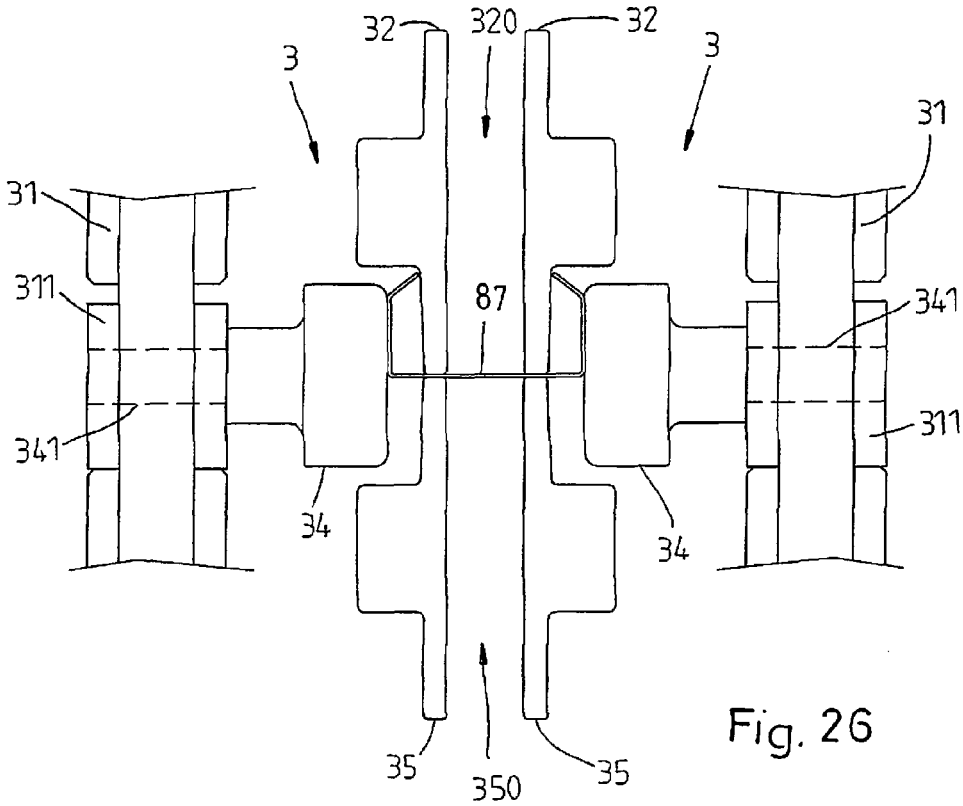
FIG. 26 is a schematic plain view showing the sheet material rammed by still another pair of forming roll sets according to the present invention.
Figure 27:
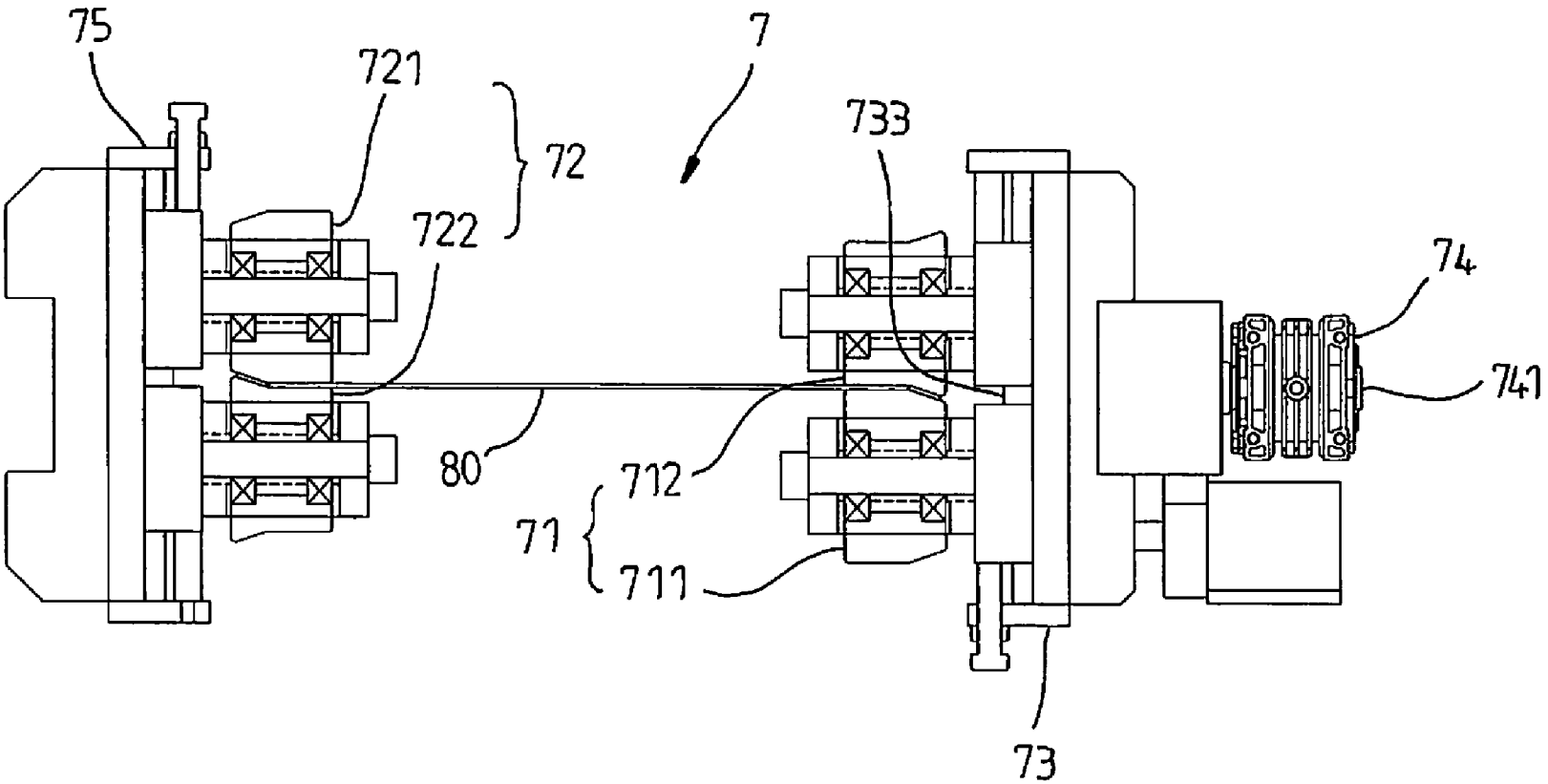
FIG. 27 is a schematic plain view showing the position of the adjustable shape-forming wheel assembly of the first adjustable shape-forming wheel set adjusted through 180-degrees.
Figure 28:
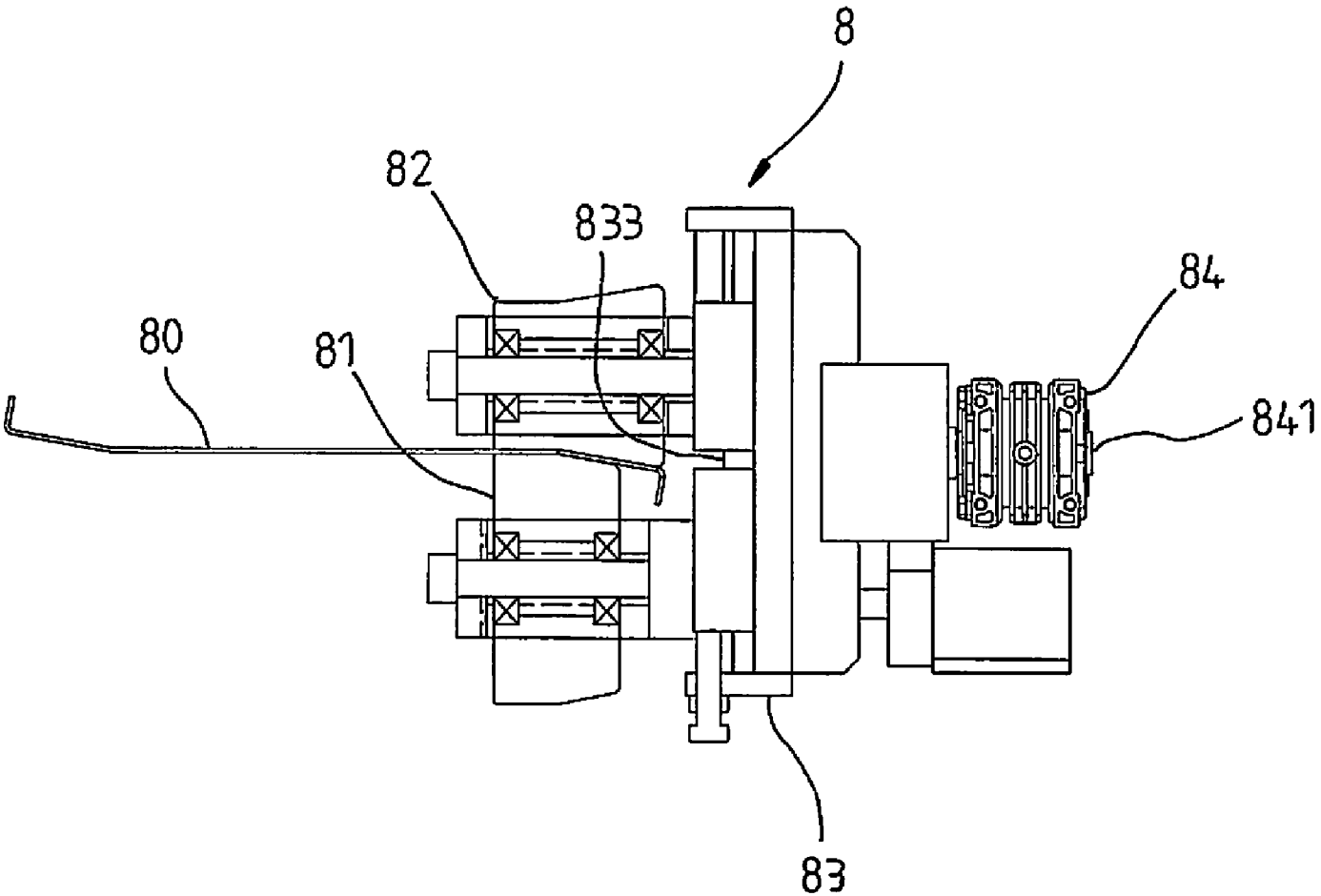
FIG. 28 is a schematic plain view showing a sheet material rammed by the second adjustable shape-forming wheel set into a Z-shaped component according to the present invention.
Figure 29:
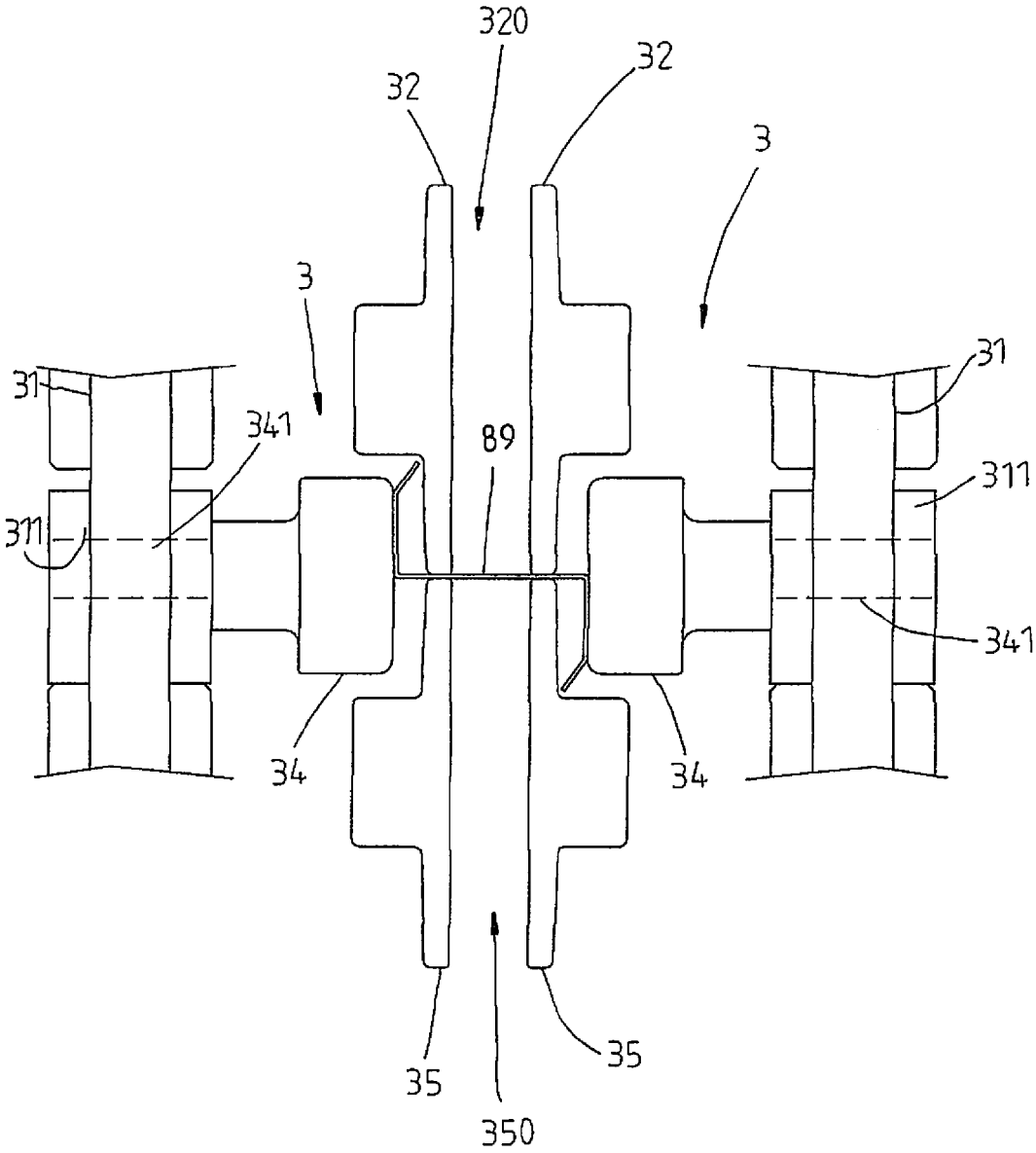
FIG. 29 is a schematic plain view showing a sheet material rolled into a Z-shaped component through the last pair of forming roll set according to the present invention.
Figure 30:
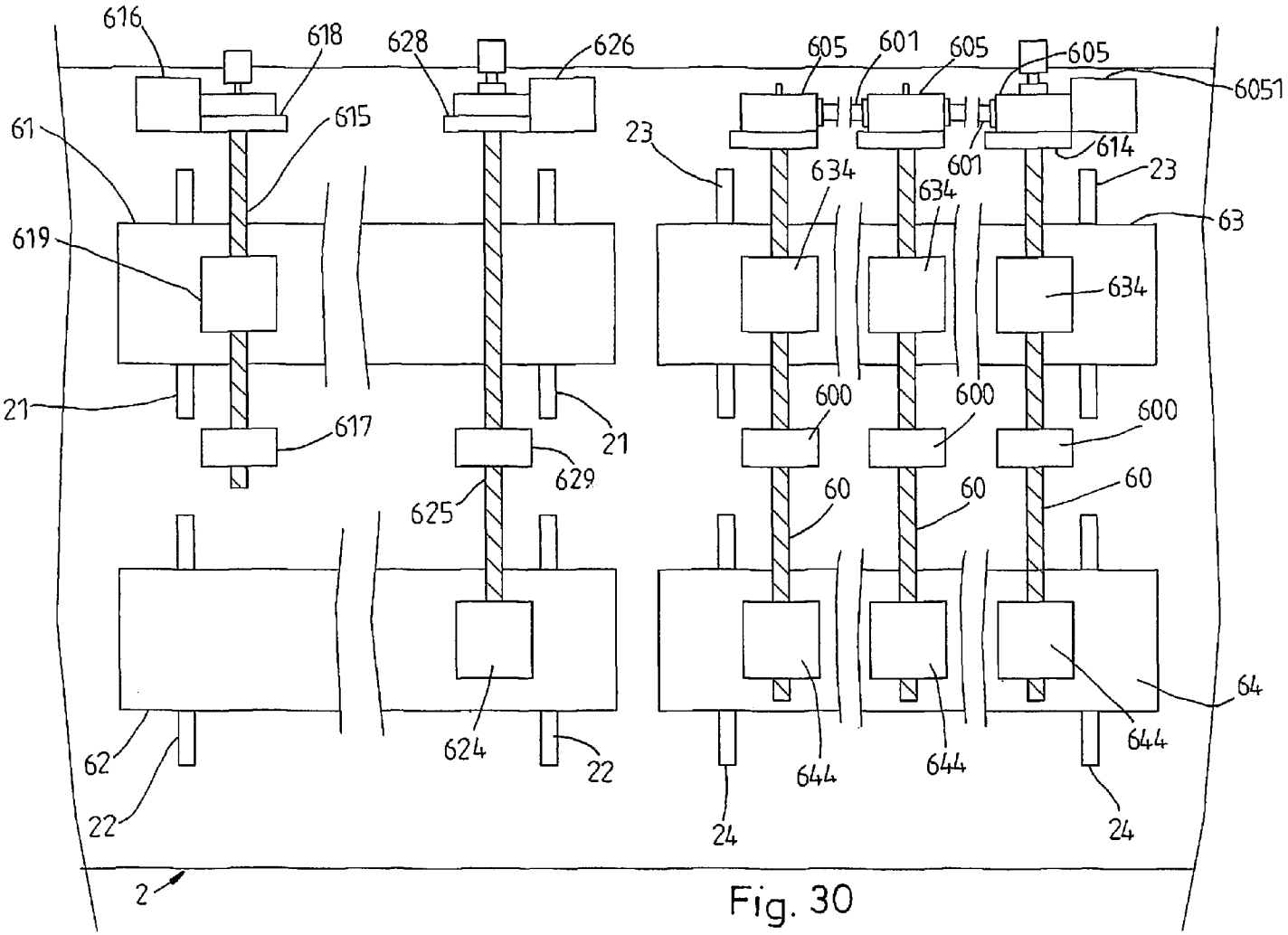
FIG. 30 is a top plain view of a part of the present invention, showing the arrangement of the first left-side bottom plate, the first right-side bottom plate, the second left-side bottom plate, the second right-side bottom plate, and the respective screw rods.

The number of the pairs of forming roll sets 3 is 15 numbered from the 1st through the 15th. As shown in FIG. 11, each forming roll set 3 comprises a rack 31, a first shaft 33 and a second shaft 36 pivotally mounted in the rack 31 in horizontal at different elevations, an impression wheel 32 fixedly mounted on one end of the first shaft 33, a first gear wheel 331 fixedly mounted on the other end of the first shaft 33, a sheet-transfer wheel 35 fixedly mounted on one end of the second shaft 36 corresponding to the impression wheel 32, a second gear wheel 361 fixedly mounted on the other end of the second shaft 36 and meshed with the first gear wheel 331, a shape-forming wheel 34, which has a wheel shaft 341 pivotally mounted in a wheel holder 311 at the rack 31 and is adapted to ram the sheet material 70 being delivered through the gap between the impression wheel 32 and the sheet-transfer wheel 35 into a predetermined shape, a reduction gear box 37, and a coupling 370 coupled between the output side of the reduction gear box 37 and the second shaft 36. Upon rotation of the second shaft 36 by the reduction gear box 37 through the coupling 370, the sheet-transfer wheel 35 and the second gear wheel 361 are rotated with the second shaft 36, and the first gear wheel 331 is driven by the second gear wheel 361 to rotate the first shaft 33 and the impression wheel 32. The roll-forming machine further comprises two motors 38 adapted to drive the reduction gear boxes 37 of the forming roll sets 3.

The first adjustable shape-forming wheel set 7 (see FIG. 14) comprises an adjustable shape-forming wheel assembly 71 mounted on the left side of the top wall of the machine base 2 and a non-adjustable shape-forming wheel assembly 72 mounted on the right side of the top wall of the machine base 2. The adjustable shape-forming wheel assembly 71 comprises a wheel holder 73 turnable relative to the machine base 2 through 180-degrees, an upper shape-forming wheel 711 and lower shape-forming wheel 712 respectively pivoted to the wheel holder 73 at different elevations, a shaft 733 affixed to the wheel holder 73, and a motor 74 having an output shaft 741 coupled to the shaft 733 and controllable subject to sensor elements 731 and 734 to rotate the shaft 733 forwards/backwards through 180-degrees. The non-adjustable shape-forming wheel assembly 72 comprises a wheel holder 75 fixedly mounted on the machine base 2, and an upper shape-forming wheel 721 and a lower shape-forming wheel 722 respectively pivoted to the wheel holder 75 at different elevations.

Figure 9:
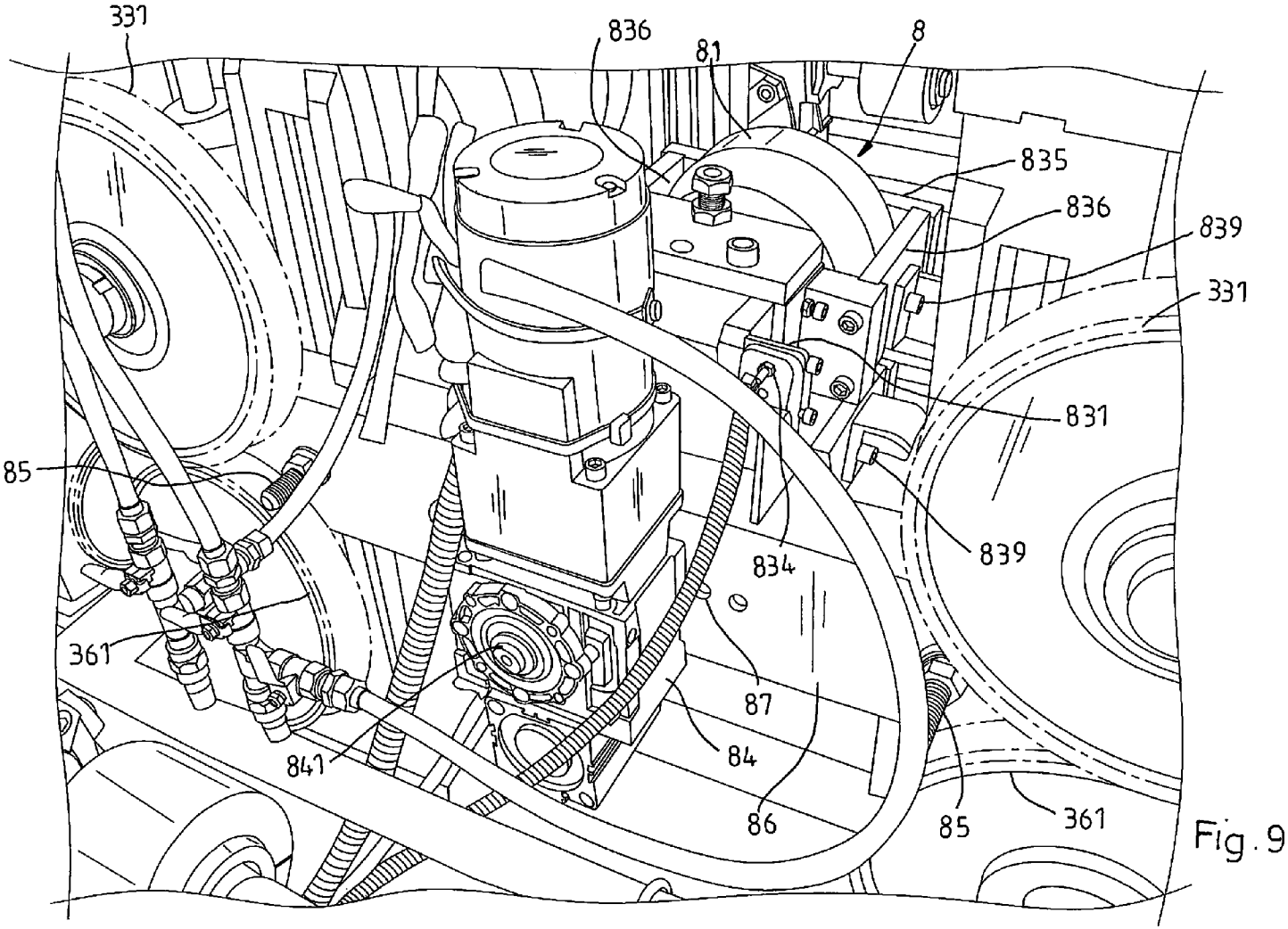
FIG. 9 is an enlarged view of still another part of the roll-forming machine according to the present invention.

The second adjustable shape-forming wheel set 8 (see FIG. 18) is mounted on the left side of the top wall of the machine base 2, comprising a wheel holder 83 turnable relative to the machine base 2 through 180-degrees, an upper shape-forming wheel 81 and lower shape-forming wheel 82 respectively pivoted to the wheel holder 83 at different elevations, a shaft 833 affixed to the wheel holder 83, and a motor 84 having an output shaft 841 coupled to the shaft 833 and controllable subject to sensor elements 831 and 834 to rotate the shaft 833 forwards/backwards through 180-degrees (see FIG. 9).

The first lower auxiliary shape-forming wheel set 41 (see FIG. 4) is mounted on the top wall of the machine base 2 and set between the $10^{th}$ pair of forming roll sets 3 and the $11^{th}$ pair of forming roll sets 3 for ramming the bottom of a sheet material 80 into a 90-degree contained angle.

The second lower auxiliary shape-forming wheel set 42 is mounted on the top wall of the machine base 2 and set between the $11^{th}$ pair of forming roll sets 3 and the $12^{th}$ pair of forming roll sets 3 for ramming the two corners of the bottom of a sheet material 80 into a 90-degree contained angle.

The upper auxiliary shape-forming wheel set 43 is mounted on the top wall of the machine base 2 and set between the $12^{th}$ pair of forming roll sets 3 and the $13^{th}$ pair of forming roll sets 3 for ramming the two corners of the top of a sheet material 80 into a 90-degree contained angle.

The small straightener 51 is set between the $13^{th}$ pair of forming roll sets 3 and the $14^{th}$ pair of forming roll sets 3 and adapted to straighten the wall of a sheet material 80.

The big straightener 52 is set at the rear side of the machine base 2 and adapted to straighten the wall of each processed C-shaped component or Z-shaped component.

The pairs of forming roll sets 3 are bilaterally arranged on the top wall of the machine base 2. The two impression wheels 32 of each pair of forming roll sets 3 are spaced from each other by a space 320 (see FIGS. 11 and 12). The sheet-transfer wheels 35 of each pair of forming roll sets 3 are spaced from each other by a space 350 (see FIGS. 11 and 12). The racks 31 of each pair of forming roll sets 3 are respectively affixed to a first left-side bottom plate 61, a first right-side bottom plate 62, a second left-side bottom plate 63 and a second right-side bottom plate 64 at the top. The first left-side bottom plate 61 and the first right-side bottom plate 62 have sliding blocks 611, 621 provided at the bottom side and respectively coupled to a first left-side rail 21 and a first right-side rail 22 at the machine base 2. The second left-side bottom plate 63 and the second right-side bottom plate 64 have sliding blocks 631, 641 provided at the bottom side and respectively coupled to a second left-side rail 23 and a second right-side rail 24 at the machine base 2 (see FIG. 12). The first left-side bottom plate 61 comprises a plurality of fixed guide blocks 614, and a plurality of screw rods 615 respectively threaded through the fixed guide blocks 614. The screw rods 615 each have one end threaded into a bearing block 617 at the machine base 2 and the other end coupled to a speed reduction motor 616 on a motor mount 618 at the machine base 2. When started the motor 616, the first left-side bottom plate 61 is forced by the screw rods 615 to move along the respective first left-side rail 21. The first right-side bottom plate 62 comprises a plurality of fixed guide blocks 624, and a plurality of screw rods 625 respectively threaded through the fixed guide blocks 624. The screw rods 625 each have one end threaded into a bearing block 629 at the machine base 2 and the other end coupled to a speed reduction motor 626 on a motor mount 628 at the machine base 2. When started the motor 626, the first right-side bottom plate 62 is forced by the screw rods 625 to move along the respective first left-side rail 22. Therefore, the distance between the first left-side bottom plate 61 and the first right-side bottom plate 62 can be adjusted conveniently. The second left-side bottom plate 63 and second right-side bottom plate 64 of each sheet-transfer roll set 3 each have a plurality of fixed guide blocks 634, 644. Screw rods 60 are respectively threaded through the fixed guide blocks 634 at the second left-side bottom plate 63 and the fixed guide blocks 644 at the second right-side bottom plate 64. The screw rods 60 each have one end threaded into a bearing block 600 at the machine base 2 and the other end coupled to a respective steering device 605 on a support 619 at the machine base 2. The steering devices 605 of the sheet-transfer roll sets 3 are respectively connected to one another by transmission shafts 601. Further, a motor 6051 is coupled to one steering device 605. When started the motor 6051, the steering devices 605 are driven to rotate the transmission shafts 601 and the screw rods 60, thereby causing the second left-side bottom plates 63 of the sheet-transfer roll sets 3 to be moved relative to the respective second right-side bottom plates 64, and therefore the pitch between the second left-side bottom plate 63 and the respective second right-side plates 64 is relatively adjusted.

When a sheet material 80 (see FIG. 4) passed over a guide block unit 1 to the machine base 2, it is immediately transferred in proper order through the impression wheel 32 and sheet-transfer wheel 35 of each of the sheet-transfer roll sets 3, and then rammed by the first adjustable shape-forming wheel set 7, the second adjustable shape-forming wheel set 8, the first lower auxiliary shape-forming wheel set 41, the second lower auxiliary shape-forming wheel set 42, the upper auxiliary shape-forming wheel set 43, the small straightener 51 and the big straightener 52 into a C-shaped component 87. When the operator turned the wheel holder of the first adjustable shape-forming wheel set 7 vertically through 180° (see FIGS. 27 and 28), a sheet material 80 can then be rammed into a Z-shaped component 89 (see FIG. 29).

The main features of the present invention are outlined hereinafter.

Figure 6:
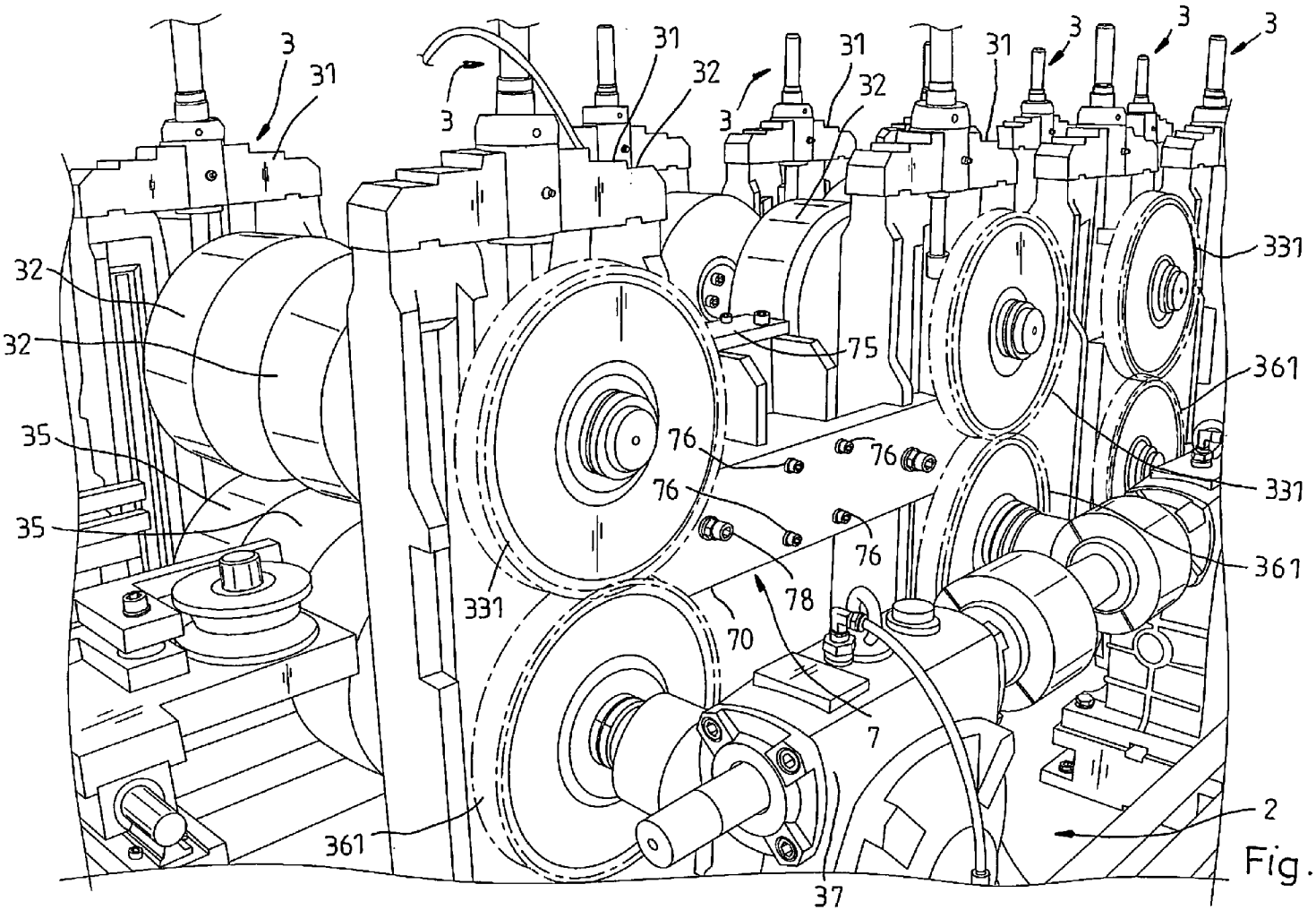
FIG. 6 is an enlarged view of a part of the roll-forming machine according to the present invention.
Figure 8:
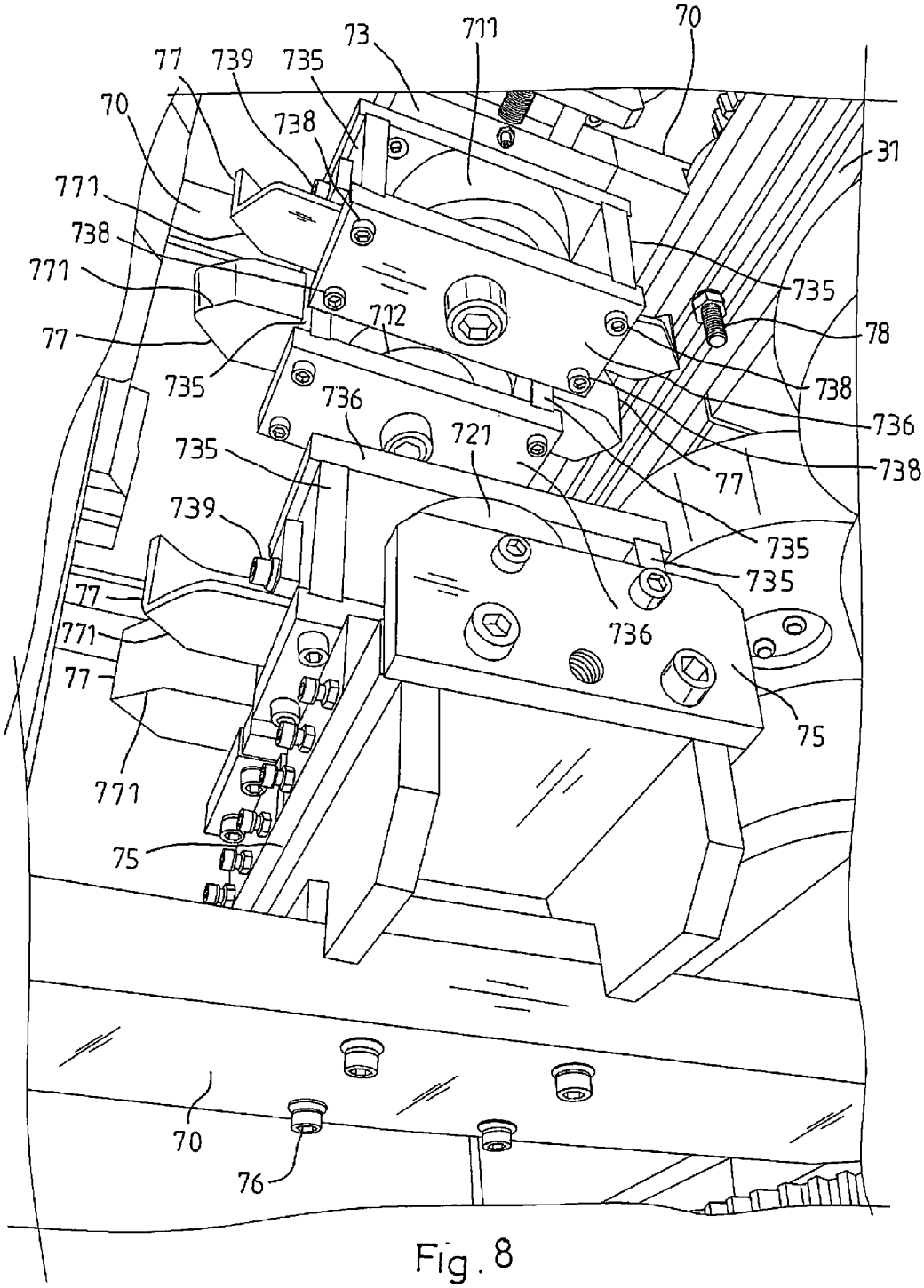
FIG. 8 is an enlarged view of still another part of the roll-forming machine according to the present invention.

The wheel holders 73 and 75 of the adjustable shape-forming wheel assembly 71 and non-adjustable shape-forming wheel assembly 72 of the first adjustable shape-forming wheel set 7 are respectively fastened to a respective connection frame bar 70 with fastening members 76 (see FIGS. 6 and 8). The two connection frame bars 70 are respectively fastened to the racks 31 of the first and second pairs of forming roll sets 3 with fastening members 78. The shaft 733 of the wheel holder 73 of the adjustable shape-forming wheel assembly 71 is pivotally connected to the associating connection frame bar 70 and rotatable with the output shaft 741 of the motor 74.

The wheel holder 83 of the adjustable shape-forming wheel set 8 is fastened to a connection frame bar 86 with fastening members 87. The two sides of the connection frame bar 86 are respectively fastened to the racks 31 of the first and fourth pairs of forming roll sets 3 with fastening members 85. The shaft 833 of the wheel holder 83 of the adjustable shape-forming wheel set 8 is pivotally connected to the associating connection frame bar 86 and rotatable with the output shaft 841 of the motor 84.

Figure 7:
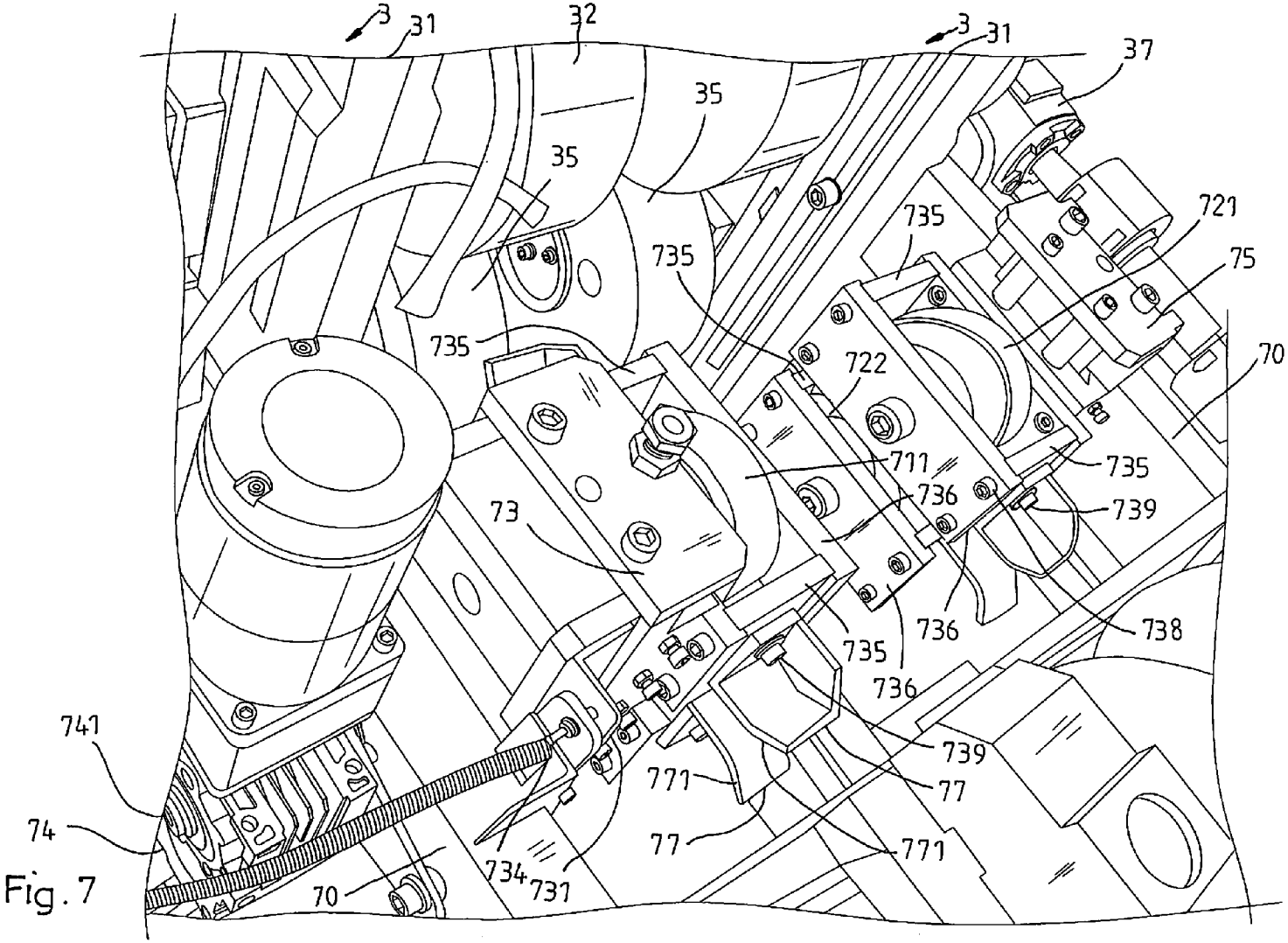
FIG. 7 is an enlarged view of another part of the roll-forming machine according to the present invention.

The wheel holders 73 and 75 of the adjustable shape-forming wheel assembly 71 and non-adjustable shape-forming wheel assembly 72 of the first adjustable shape-forming wheel set 7 are respectively provided with a respective upper rack and a respective lower rack, as shown in FIGS. 7 and 8. The upper and lower racks each have two sidewalls 735 and a coupling wall 736. The upper shape-forming wheel 711 of the adjustable shape-forming wheel assembly 71 is pivotally mounted in the upper rack with a respective pivot shaft 737 (see FIG. 14). The coupling wall 736 of each upper rack has two sides respectively fastened to the two sidewalls 735 with fastening members 738. The sidewalls 735 of each upper rack have a respective guide block 77 affixed thereto with respective fastening members 739 (see FIG. 8). Each guide block 77 has a beveled guide face 771 for guiding a sheet material 80 toward the upper shape-forming wheel 711 of the adjustable shape-forming wheel assembly 71. The lower shape-forming wheel 712 of the adjustable shape-forming wheel assembly 71 is pivotally mounted in the lower rack with a respective pivot shaft 737 (see FIG. 14). The coupling wall 736 of each lower rack has two sides respectively fastened to the two sidewalls 735 with fastening members 738. The sidewalls 735 of each lower rack have a respective guide block 77 affixed thereto with respective fastening members 739. Each guide block 77 has a beveled guide face 771 for guiding a sheet material 80 toward the lower shape-forming wheel 712 of the adjustable shape-forming wheel assembly 71.

Figure 10:
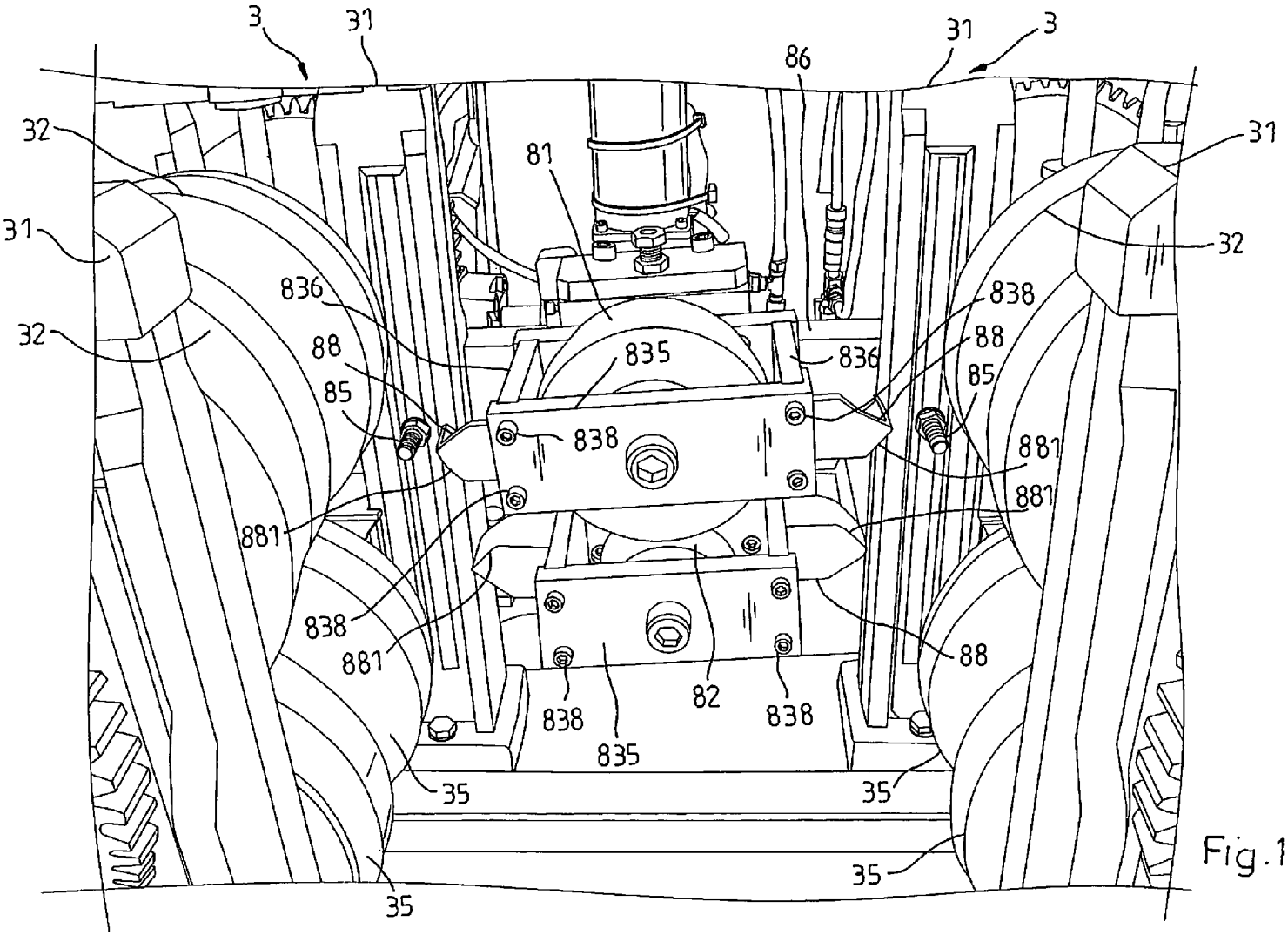
FIG. 10 is an enlarged view of still another part of the roll-forming machine according to the present invention.

The wheel holder 83 of the adjustable shape-forming wheel set 8 is provided with an upper rack and a lower rack, as shown in FIGS. 9 and 10. The upper and lower racks each have two sidewalls 836 and a coupling wall 835 (see FIG. 18). The upper shape-forming wheel 81 is pivotally mounted in the upper rack with a respective pivot shaft 837 (see FIG. 18). The coupling wall 835 of the upper rack of the adjustable shape-forming wheel set 8 has two sides respectively fastened to the two sidewalls 836 of the upper rack of the adjustable shape-forming wheel set 8 with fastening members 838. The sidewalls 836 of the upper rack of the adjustable shape-forming wheel set 8 have a respective guide block 88 affixed thereto with respective fastening members 839 (see FIG. 9). Each guide block 88 has a beveled guide face 881 for guiding a sheet material 80 toward the upper shape-forming wheel 81. The coupling wall 835 of the lower rack of the adjustable shape-forming wheel set 8 has two sides respectively fastened to the two sidewalls 836 of the lower rack of the adjustable shape-forming wheel set 8 with fastening members 838. The sidewalls 836 of the lower rack of the adjustable shape-forming wheel set 8 have a respective guide block 88 affixed thereto with respective fastening members 839. Each guide block 88 has a beveled guide face 881 for guiding a sheet material 80 toward the lower shape-forming wheel 82.

As stated above, the invention has the following features and advantages:

1. The adjustable shape-forming wheel assembly 71 and non-adjustable shape-forming wheel assembly 72 of the first adjustable shape-forming wheel set 7 and the adjustable shape-forming wheel set 8 are respectively connected to the corresponding racks 31 of the sheet-transfer roll sets 3 through respective connection frame bars 70 and 86. Therefore, a wide space is provided around each of the adjustable shape-forming wheel assembly 71, the non-adjustable shape-forming wheel assembly 72 and the adjustable shape-forming wheel set 8, facilitating mounting and dismounting.

2. When the upper shape-forming wheel 711 or lower shape-forming wheel 712 of the adjustable shape-forming wheel assembly 71 or the upper shape-forming wheel 721 or lower shape-forming wheel 722 of the non-adjustable shape-forming wheel assembly 72 or the upper shape-forming wheel 81 or lower shape-forming wheel 82 of the adjustable shape-forming wheel set 8 is damaged and a repair work is necessary, the fastening members 738, 838 and the pivot shaft 737, 837 can be removed conveniently for quick performance of the repair work.

3. The coupling walls 735 and 835 and sidewalls 736 and 836 are mounted with the respective pivot shafts 737 and 837 and fastening members 738 and 838 for quick positioning of the upper shape-forming wheels 711, 721 and 81 and the lower shape-forming wheels 712, 722 and 82, assuring high stability and accurate processing.

A prototype of roll-forming machine has been constructed with the features of FIGS. 3-30. The roll-forming machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A roll-forming machine for the formation of C-shaped components and Z-shaped components selectively from sheet materials, comprising:

a machine base, said machine base comprising a guide block unit provided at a front side thereof for guiding in a sheet material for processing;

multiple pairs of forming roll sets bilaterally mounted on said machine base, the multiple pairs of forming roll sets including a first pair of forming roll sets, a second pair of forming roll sets, a fourth pair of forming roll sets, an $11^{th}$ pair of forming roll sets, a $12^{th}$ pair of forming roll sets, a $13^{th}$ pair of forming roll sets, and a $14^{th}$ pair of forming roll sets, each said forming roll set comprising a rack, a first shaft and a second shaft pivotally mounted in said rack in horizontal at different elevations, an impression wheel fixedly mounted on one end of said first shaft, a first gear wheel fixedly mounted on an opposite end of said first shaft, a sheet-transfer wheel fixedly mounted on one end of said second shaft corresponding to said impression wheel, a second gear wheel fixedly mounted on an opposite end of said second shaft and meshed with said first gear wheel, a shape-forming wheel, which has a wheel shaft pivotally mounted in a wheel holder at said rack and is adapted to ram the sheet material being delivered through a gap between said impression wheel and said sheet-transfer wheel into a predetermined shape, a reduction gear box, a coupling coupled between an output side of said reduction gear box and said second shaft, and a motor for rotating said reduction gear box, two impression wheels of each said pair of forming roll sets being spaced from each other by a space, the sheet-transfer wheels of each said pair of forming roll sets being spaced from each other by a space, racks of each said pair of forming roll sets being respectively affixed to a first left-side bottom plate, a first right-side bottom plate, a second left-side bottom plate and a second right-side bottom plate at a top side, said first left-side bottom plate and said first right-side bottom plate having a respective sliding block respectively provided at a bottom side thereof and respectively coupled to a first left-side rail and a first right-side rail at said machine base, said second left-side bottom plate and said second right-side bottom plate having a respective sliding block provided at a bottom side thereof and respectively coupled to a second left-side rail and a second right-side rail at said machine base, said first left-side bottom plate comprising a plurality of fixed guide blocks and a plurality of screw rods respectively threaded through said fixed guide blocks, the screw rods of said first left-side bottom plate each having one end threaded into a bearing block at the machine base and an opposite end of the screw rods coupled to a speed reduction motor on a motor mount at said machine base in such a manner that when the motor is started, said first left-side bottom plate is forced by the respective screw rods to move along the respective first left-side rail, said first right-side bottom plate comprising a plurality of fixed guide blocks and a plurality of screw rods respectively threaded through the fixed guide blocks, the screw rods of said first right-side bottom plate each having one end threaded into a bearing block at the machine base and an opposite end coupled to a speed reduction motor on a motor mount at the machine base in such a manner that when the motor is started, said first right-side bottom plate is forced by the respective screw rods to move along the respective first left-side rail, said second left-side bottom plate and said second right-side bottom plate of each said sheet-transfer roll set each having a plurality of fixed guide blocks for the mounting of screw rods that have a respective first end threaded into a bearing block said machine base and respective second end coupled to a respective steering device on a support at said machine base, the steering devices of said sheet-transfer roll sets being respectively connected to one another by transmission shafts and rotatable by one steering device;

a first adjustable shape-forming wheel set, said first adjustable shape-forming wheel set comprising an adjustable shape-forming wheel assembly mounted on said machine base at a left side and a non-adjustable shape-forming wheel assembly mounted on said machine base at a right side, said adjustable shape-forming wheel assembly comprising a wheel holder turnable vertically relative to said machine base through 180-degrees, an upper shape-forming wheel and a lower shape-forming wheel respectively pivoted to the wheel holder at different elevations, a shaft affixed to the wheel holder, and a motor having an output shaft coupled to the shaft and controllable subject to sensor elements to rotate the shaft forwards/backwards through 180-degrees, said non-adjustable shape-forming wheel assembly comprising a wheel holder fixedly mounted on said machine base and an upper shape-forming wheel and a lower shape-forming wheel respectively pivoted to the wheel holder at different elevations;

a second adjustable shape-forming wheel set mounted on said machine base at the left side of the machine base, said second adjustable shape-forming wheel set comprising a wheel holder vertically turnable relative to said machine base through 180-degrees, an upper shape-forming wheel and lower shape-forming wheel respectively pivoted to the wheel holder of said second adjustable shape-forming wheel set at different elevations, a shaft affixed to the wheel holder of said second adjustable shape-forming wheel set, and a motor having an output shaft coupled to the shaft of said second adjustable shape-forming wheel set and controllable subject to sensor elements to rotate the shaft of said second adjustable shape-forming wheel set forwards/backwards through 180-degrees;

a first lower auxiliary shape-forming wheel set mounted on said machine base and set between the $10^{th}$ pair of forming roll sets and the $11^{th}$ pair of forming roll sets for ramming a bottom of a sheet material into a 90-degree contained angle;

a second lower auxiliary shape-forming wheel set mounted on said machine base and set between the $11^{th}$ pair of forming roll sets and the $12^{th}$ pair of forming roll sets for ramming two corners of a bottom of a sheet material into a 90-degree contained angle;

an upper auxiliary shape-forming wheel set mounted on said machine base and set between the $12^{th}$ pair of forming roll sets and the $13^{th}$ pair of forming roll sets for ramming two corners of a top of a sheet material into a 90-degree contained angle;

a small straightener set between the $13^{th}$ pair of forming roll sets and the $14^{th}$ pair of forming roll sets and adapted to straighten a wall of each sheet material being fed into the roll-forming machine; and a big straightener set at a rear side of said machine base and adapted to straighten each processed C-shaped component or Z-shaped component;

wherein:

the wheel holders of said adjustable shape-forming wheel assembly and said non-adjustable shape-forming wheel assembly of said first adjustable shape-forming wheel set are respectively fastened to a respective connection frame bar with fastening members; two connection frame bars of said first adjustable shape-forming wheel set are respectively fastened to the racks of the first and second pairs of forming roll sets with fastening members; the shaft of the wheel holder of said adjustable shape-forming wheel assembly is pivotally connected to the associating connection frame bar and rotatable with the output shaft of the motor of said adjustable shape-forming wheel assembly;

the wheel holder of said adjustable shape-forming wheel set is fastened to a connection frame bar with fastening members, the connection frame bar of said adjustable shape-forming wheel set having two sides respectively fastened to the racks of the first and fourth pairs of forming roll sets with fastening members; the shaft of the wheel holder of said adjustable shape-forming wheel set is pivotally connected to the associating connection frame bar and rotatable with the output shaft of the motor of said adjustable shape-forming wheel set.

2. The roll-forming machine as claimed in claim 1, wherein the wheel holders of said adjustable shape-forming wheel assembly and said non-adjustable shape-forming wheel assembly of said first adjustable shape-forming wheel set are respectively provided with a respective upper rack and a respective lower rack, said upper racks and said lower racks each having two sidewalls and a coupling wall, the upper shape-forming wheel of said adjustable shape-forming wheel assembly being pivotally mounted in the upper rack of said adjustable shape-forming wheel assembly with a respective pivot shaft, the coupling wall of each said upper rack having two sides respectively fastened to the two sidewalls of the respective upper rack with fastening members, the sidewalls of each said upper rack having a respective guide block affixed thereto with respective fastening members, each said guide block having a beveled guide face for guiding a sheet material toward the upper shape-forming wheel of said adjustable shape-forming wheel assembly, the lower shape-forming wheel of said adjustable shape-forming wheel assembly being pivotally mounted in the lower rack of said adjustable shape-forming wheel assembly with a respective pivot shaft, the coupling wall of each said lower rack having two sides respectively fastened to the two sidewalls of the respective lower rack with fastening members, the sidewalls of each said lower rack having a respective guide block affixed thereto with respective fastening members, each guide block of each said lower rack having a beveled guide face for guiding a sheet material toward the lower shape-forming wheel of said adjustable shape-forming wheel assembly.

3. The roll-forming machine as claimed in claim 1, wherein the wheel holder of said adjustable shape-forming wheel set is provided with an upper rack and a lower rack, the upper rack and lower rack of said adjustable shape-forming wheel set each having two sidewalls and a coupling wall, the upper shape-forming wheel of said adjustable shape-forming wheel set being pivotally mounted in the upper rack of said adjustable shape-forming wheel set with a respective pivot shaft, the coupling wall of the upper rack of said adjustable shape-forming wheel set having two sides respectively fastened to the two sidewalls of the respective upper rack with fastening members, the sidewalls of the upper rack of said adjustable shape-forming wheel set having a respective guide block affixed thereto with respective fastening members, each guide block of said adjustable shape-forming wheel set having a beveled guide face for guiding a sheet material toward the upper shape-forming wheel of said adjustable shape-forming wheel set, the coupling wall of the lower rack of said adjustable shape-forming wheel set having two sides respectively fastened to the two sidewalls of the lower rack of said adjustable shape-forming wheel set with fastening members, the sidewalls of the lower rack of said adjustable shape-forming wheel set having a respective guide block affixed thereto with respective fastening members, each guide block of said adjustable shape-forming wheel set having a beveled guide face for guiding a sheet material toward the lower shape-forming wheel of said adjustable shape-forming wheel set.

* * * * *